US012018493B2

(12) United States Patent
Briggs et al.

(10) Patent No.: US 12,018,493 B2
(45) Date of Patent: Jun. 25, 2024

(54) BUILDING SURFACE PRODUCT INCLUDING ATTACHMENT CLIP, BUILDING SURFACE SYSTEM, AND METHOD OF MANUFACTURE

(71) Applicant: CertainTeed Gypsum, Inc., Malvern, PA (US)

(72) Inventors: Timothy Briggs, Clinton, MA (US); William Lentlie, Worcester, MA (US); Brock Jacobites, Northborough, MA (US); Kim Dupont-Madinier, Somerville, MA (US); David Knutson, Lunenburg, MA (US); Brian Butler, Bridgewater, MA (US); Aaron Bruckerhoff, Medfield, MA (US)

(73) Assignee: CertainTeed Gypsum, Inc., Malven, PA (US)

( * ) Notice: Subject to any disclaimer, the term of this patent is extended or adjusted under 35 U.S.C. 154(b) by 109 days.

(21) Appl. No.: 17/458,847

(22) Filed: Aug. 27, 2021

(65) Prior Publication Data

US 2022/0064961 A1 Mar. 3, 2022

Related U.S. Application Data

(60) Provisional application No. 63/235,504, filed on Aug. 20, 2021, provisional application No. 63/071,142, filed on Aug. 27, 2020.

(51) Int. Cl.
*E04F 13/08* (2006.01)

(52) U.S. Cl.
CPC ..... *E04F 13/0835* (2013.01)

(58) Field of Classification Search
None
See application file for complete search history.

(56) References Cited

U.S. PATENT DOCUMENTS 2,335,565 A * 11/1943 Gibson ..... E04F 13/0835 52/681
2,336,251 A * 12/1943 Hoggatt ..... E04C 2/24 106/779

(Continued)

FOREIGN PATENT DOCUMENTS

CA 995871 A 8/1976
CA 1329690 C 5/1994

(Continued)

OTHER PUBLICATIONS

International Search Report and Written Opinion in PCT/US2021/047858, dated Dec. 14, 2021.

*Primary Examiner* — Joshua K Ihezie
(74) *Attorney, Agent, or Firm* — McDonnell Boehnen Hulbert & Berghoff LLP

(57) ABSTRACT

The present disclosure relates generally to building surface products, for example, suitable for forming a building surface. The present disclosure relates more particularly to a building surface product including a panel having a front surface, a rear surface, and a gypsum body between the front surface and rear surface. A first attachment clip is secured to the rear surface of the panel and includes a first leg extending outward from the rear surface of the panel. A retaining flange is coupled to the first leg and extends over the rear surface in a first direction. The retaining flange includes a slot that is configured to receive a post so as to secure the building surface product to a support structure. A first fastener that penetrates the rear surface of the panel is attached to the first leg so as to secure the attachment clip to the panel.

18 Claims, 14 Drawing Sheets

(56) References Cited

U.S. PATENT DOCUMENTS

| | | | | | |
|---|---|---|---|---|---|
| 2,379,595 | A * | 7/1945 | Roe | E04F 15/10 | 52/390 |
| 3,256,666 | A * | 6/1966 | Farmer | E04B 2/76 | 52/717.06 |
| 3,444,657 | A | 5/1969 | Swanson | | |
| 3,576,091 | A | 4/1971 | Smith | | |
| 3,733,755 | A | 5/1973 | Butler | | |
| 3,741,843 | A | 6/1973 | Louis | | |
| 3,998,018 | A * | 12/1976 | Hodges | E04B 2/789 | 52/363 |
| 4,157,271 | A | 6/1979 | Moore | | |
| 4,236,362 | A * | 12/1980 | Omholt | E04H 3/14 | 52/223.6 |
| 4,313,991 | A | 2/1982 | Lamb | | |
| 4,388,031 | A * | 6/1983 | Rodgers | F16B 19/1072 | D8/382 |
| 4,576,532 | A * | 3/1986 | Hanson | F27D 1/141 | 110/336 |
| 4,709,514 | A | 12/1987 | Mitchell | | |
| 5,333,433 | A | 8/1994 | Porambo | | |
| 6,202,377 | B1 | 3/2001 | Krieger | | |
| 6,226,957 | B1 | 5/2001 | Slough | | |
| 6,413,606 | B1 | 7/2002 | Calderon | | |
| 6,951,087 | B2 | 10/2005 | Weurman | | |
| 7,191,570 | B1 | 3/2007 | Eaton | | |
| 7,524,129 | B2 * | 4/2009 | Selle | F16B 5/0642 | 411/173 |
| 8,429,866 | B2 | 4/2013 | Knight | | |
| 8,707,648 | B2 * | 4/2014 | Timko | E04F 13/0819 | 52/775 |
| 8,871,326 | B2 * | 10/2014 | Flennert | F24F 13/0263 | 428/312.4 |
| 9,063,858 | B2 | 6/2015 | Macdonald | | |
| 9,080,331 | B2 | 7/2015 | Aboukhailil | | |
| 10,208,476 | B2 * | 2/2019 | Van Rijsingen | E04F 19/062 | |
| 2004/0040239 | A1 * | 3/2004 | Baillargeon | E04C 2/34 | 52/309.9 |
| 2004/0071933 | A1 | 4/2004 | McConnell et al. | | |
| 2005/0193666 | A1 | 9/2005 | McConnell | | |
| 2006/0070331 | A1 | 4/2006 | Yakobics | | |
| 2009/0077922 | A1 | 3/2009 | Pettine | | |
| 2009/0084055 | A1 * | 4/2009 | Mangiardi | E04F 13/083 | 52/630 |
| 2009/0241444 | A1 | 10/2009 | Griffiths | | |
| 2011/0083392 | A1 * | 4/2011 | Timko | F16B 5/065 | 52/582.1 |
| 2011/0192519 | A1 * | 8/2011 | Gangl | E04F 13/14 | 52/287.1 |
| 2014/0311064 | A1 * | 10/2014 | Beaty | E04B 2/02 | 52/204.53 |
| 2016/0201325 | A1 | 7/2016 | Moore | | |
| 2018/0073246 | A1 * | 3/2018 | Ullett | E04B 2/7411 | |
| 2018/0283002 | A1 * | 10/2018 | Tanguay | E04F 19/064 | |
| 2019/0211549 | A1 * | 7/2019 | Moscovitch | E04B 1/35 | |
| 2021/0017764 | A1 * | 1/2021 | Jenkins | E04C 2/043 | |
| 2021/0295813 | A1 * | 9/2021 | Gernhart | G10K 11/16 | |
| 2022/0064961 | A1 * | 3/2022 | Briggs | E04F 13/14 | |

FOREIGN PATENT DOCUMENTS

| | | | | |
|---|---|---|---|---|
| CA | 3051808 | A1 | 9/2018 | |
| CN | 201310169 | Y | 9/2009 | |
| CN | 103924762 | A | 7/2014 | |
| CN | 204001571 | U | 12/2014 | |
| CN | 204040216 | U | 12/2014 | |
| CN | 104831895 | A | 8/2015 | |
| CN | 105308246 | A | 2/2016 | |
| DE | 202010005397 | U1 | 7/2010 | |
| DE | 102018008489 | A1 | 5/2019 | |
| JP | H0932195 | A | 2/1997 | |
| JP | 2017-197936 | A | 11/2017 | |
| JP | 2019-085733 | A | 6/2019 | |
| KR | 585459 | B1 * | 6/2006 | |
| WO | 2012152994 | A1 | 11/2012 | |
| WO | 2015057732 | A1 | 11/2016 | |
| WO | WO-2019034923 | A1 * | 2/2019 | E04F 13/0835 |

* cited by examiner

BUILDING SURFACE PRODUCT INCLUDING ATTACHMENT CLIP, BUILDING SURFACE SYSTEM, AND METHOD OF MANUFACTURE

CROSS-REFERENCE TO RELATED APPLICATIONS

This application claims the benefit of priority of U.S. Provisional Patent Application No. 63/071,142, filed Aug. 27, 2020 and U.S. Provisional Patent Application No. 63/235,504, filed Aug. 20, 2021, each of which is hereby incorporated herein by reference in its entirety.

BACKGROUND OF THE DISCLOSURE

1. Field of the Disclosure

The present disclosure relates generally to building surface products, for example, panels suitable for forming a building surface. The present disclosure relates more particularly to building surface products having attachment clips for securing the panels to a support structure.

2. Technical Background

Prefabricated panels, for example gypsum panels that are commonly referred to as drywall, are often used to construct building surfaces. The panels are attached to a supporting structure, such as the joists of a wall frame. Once the panels are hung on the supporting structure, the surface is finished using joint compound or another material to create a smooth surface. The surface may then be painted or covered with wall paper.

Gypsum panels are advantageous for use as a building surface for various reasons. Such panels are incredibly durable, have excellent fire resistance, are easily repaired, and are easy to mount on a supporting structure. Typically, mounting gypsum panels only requires attaching the panels to an underlying supporting structure using mechanical fasteners, such as screws.

While the mounting of gypsum panels is relatively easy, most panels are finished by covering the joints between the panels and the fasteners in order to create a smooth surface. The panels are then painted or covered with wall paper to create a pleasing aesthetic. The process of finishing the building surface is time consuming, as each application of joint compound or paint should be dried before the subsequent step can be performed. Moreover, the finishing steps require uncommon skills.

Further, after traditional gypsum panels are installed, removing the panels requires damaging a portion of the panels and the surface finish. Accordingly, when mechanical, electrical, and plumbing components behind the building surface need to be repaired, the building surface is at least partially damaged to gain access to the components. After the work on the hidden components is completed, the building surface needs to be repaired and finished once again. For these reasons, the present inventors have determined that a building surface product that can be installed more quickly would be attractive to both builders and customers.

SUMMARY OF THE DISCLOSURE

In one aspect, the present disclosure provides a building surface product comprising:

- a substantially planar panel having a first side, a second side, a first end, a second end, a front surface, a rear surface, and a gypsum body between the front surface and rear surface;
- a first attachment clip secured to the rear surface of the panel, the first attachment clip including:
  - a first leg extending outward from the rear surface of the panel, and
  - a retaining flange coupled to the first leg, the retaining flange extending over the rear surface in a first direction and including a slot configured to receive a post so as to secure the building surface product to a support structure; and
- a first fastener that penetrates the rear surface of the panel, the first fastener being attached to the first leg so as to secure the attachment clip to the panel.

In another aspect, the disclosure provides a building surface system comprising:

- a support structure comprising:
  - a plurality of framing elements forming a support frame,
  - a first post extending outward from a front surface of the support frame; and
- a first building surface product according to the disclosure secured to the support structure, wherein the slot in the retaining flange of the first attachment clip of the first building surface product receives the first post of the support structure so as to attach the first building surface product against the support structure.

In another aspect, the disclosure provides a method of forming the building surface system according to the disclosure, the method comprising:

- positioning the first building surface product in front of the support structure such that the rear surface of the panel of the first building surface product faces the support structure and the first post is adjacent to an opening to the slot in the retaining flange of the first attachment clip of the first building surface product; and
- securing the first building surface product to the support structure by sliding the first building surface product with respect to the support structure such that the first post enters the slot in the retaining flange of the first attachment clip and is moved to an assembled position where the first post is disposed in the slot in the retaining flange, the first post supports the first building surface product, and the first post retains the first building surface product against the support structure.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have noted that conventional building surface products are time-consuming to install and require skill to finish. The present inventors have unexpectedly determined that a building surface product that can be installed more quickly and without requiring specific skills to finish would be attractive to builders and customers.

Accordingly, one aspect of the disclosure is a building surface product that includes a substantially planar panel and an attachment clip secured to a rear surface of the panel. The panel has a first side, a second side, a first end, a second end, a front surface, a rear surface, and a gypsum body between the front surface and rear surface. The first attachment clip includes a first leg extending outward from the rear surface of the panel and a retaining flange coupled to the first leg. The retaining flange extends over the rear surface in a first direction and includes a slot configured to receive a post so as to secure the building surface product to a support structure. Further, a first fastener penetrates the rear surface of the panel and is attached to the first leg so as to secure the attachment clip to the panel.

Figure 1A:
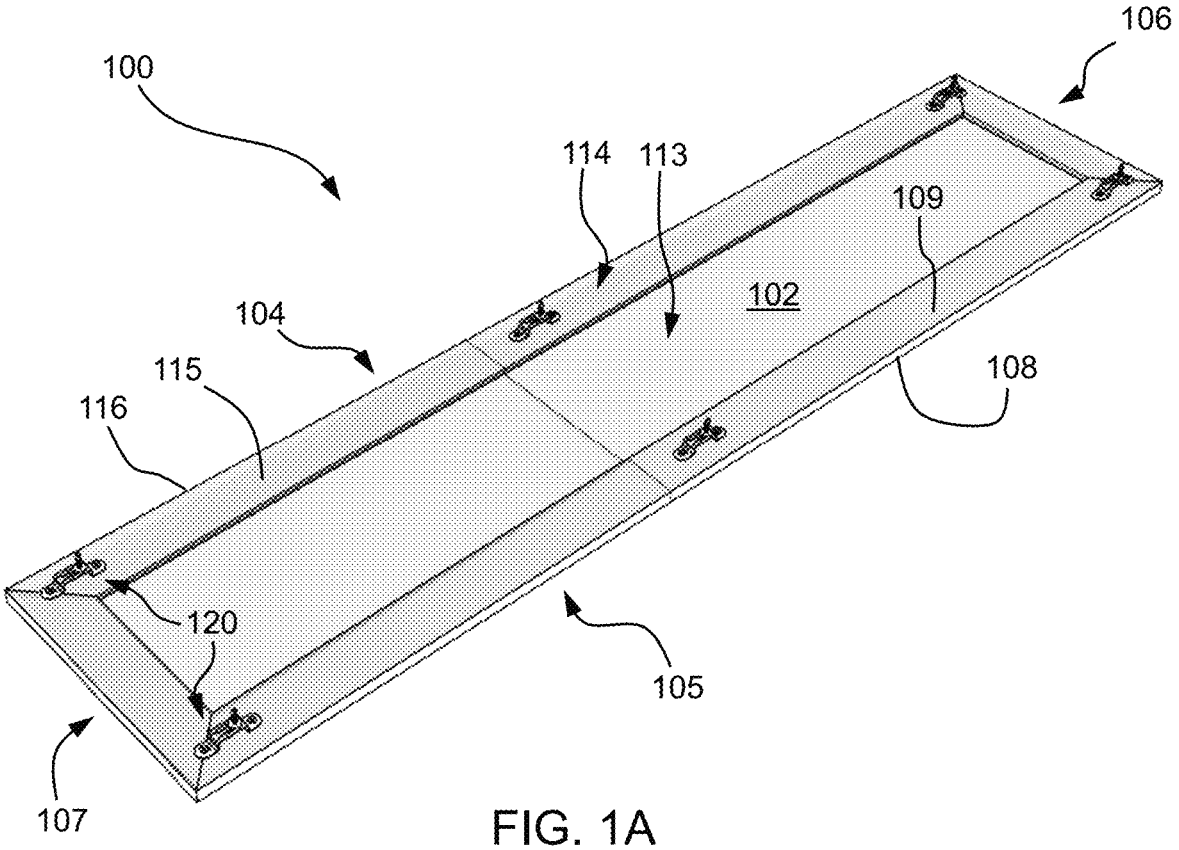
FIG. 1A is a schematic perspective view of a building surface product according to an embodiment of the disclosure.
Figure 1B:
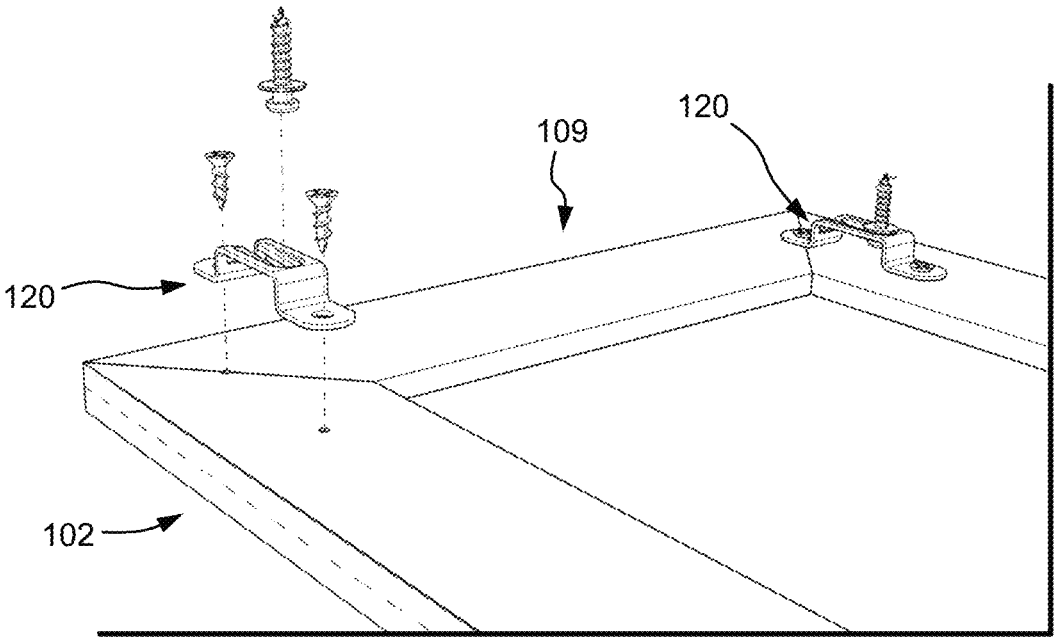
FIG. 1B is a schematic perspective view of a portion of the building surface product of FIG. 1A.

The rear surface of such a building surface product is shown in perspective view in FIG. 1A. Building surface product 100 includes a planar panel 102 in the form of a rectangle that has a first side 104, a second side 105, a first end 106, a second end 107, a front surface 108, and a rear surface 109. Further, panel 102 includes a gypsum body 110 (see FIGS. 1C and 1D) that is disposed between the front surface 108 and the rear surface 109. Building surface product 100 also includes a number of attachment clips 120 secured to rear surface 109 of panel 102. FIG. 1B shows greater detail of two of the attachment clips 120 secured to rear surface 109 of panel 102, and FIG. 1C shows a cross-sectional view of a first attachment clip 120 secured to the rear surface 109 of panel 102.

Figure 1C:
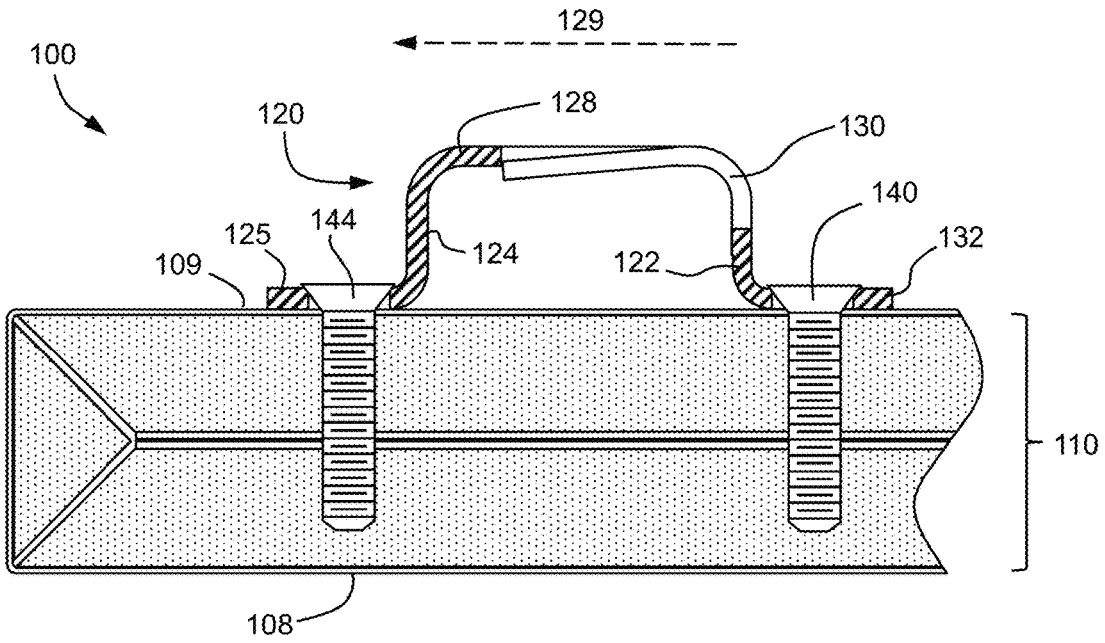
FIG. 1C is a schematic cross-sectional view of a portion of the building surface product of FIG. 1A.

As illustrated in FIG. 1C, first attachment clip 120 includes a first leg 122 extending outward from rear surface 109 of panel 102 and a retaining flange 128 coupled to first leg 122. The retaining flange 128 extends in a first direction 129 over the rear surface 109 of panel 102. The first attachment clip 120 is secured to panel 102 by a first fastener 140 that penetrates rear surface 109 and extends into gypsum body 110 of panel 102.

Figure 1D:
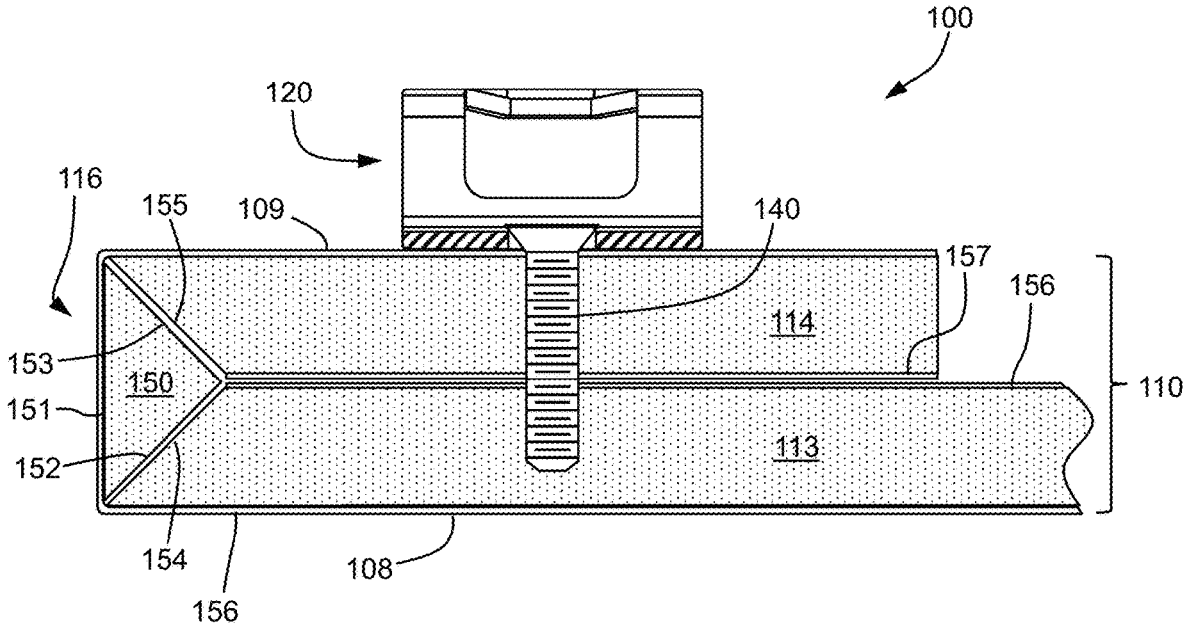
FIG. 1D is a schematic cross-sectional view of a portion of the building surface product of FIG. 1A from a different direction than FIG. 1C.
Figure 1E:
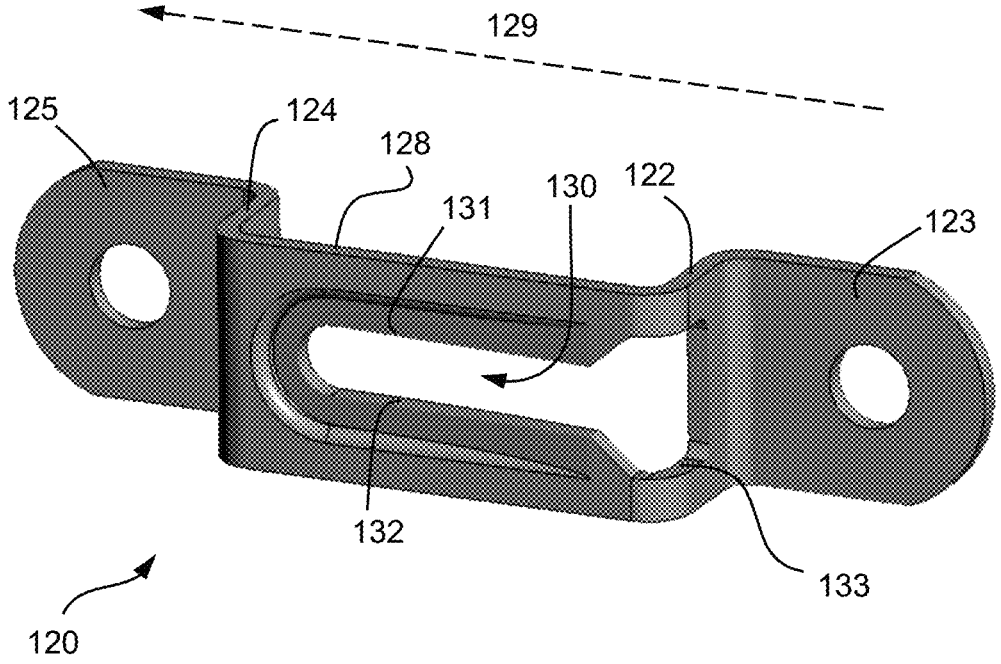
FIG. 1E is a detailed schematic perspective view of an attachment clip of the building surface product of FIG. 1A.

As shown more clearly in FIGS. 1C and 1E, the retaining flange 128 of first attachment clip 120 includes a slot 130 that extends across a portion of the retaining flange 128. The slot 130 is configured to receive a post as described in more detail below and shown, for example, in FIGS. 8A and 8B.

In other embodiments, the attachment clip may have another form. For example, in some embodiments the attachment clip may be in the form of a press-on connector that receives or is received by a corresponding press-on connector. Other embodiments of the attachment clip are also possible.

In certain embodiments of the building surface product as otherwise described herein, the gypsum body includes a front layer and a reinforcing layer disposed behind the front layer. For example, as shown in FIGS. 1A through 1D, gypsum body 110 of panel 102 includes a front layer 113 that extends across the width and length of panel 102 from first side 104 to second side 105 and from first end 106 to second end 107. In addition, a reinforcing layer 114 extends around the perimeter of panel 102 behind front layer 113. The reinforcing layer 114 provides a greater thickness to gypsum body 110 around the perimeter of panel 102, and may assist in securing fasteners, such as first fastener 140 in the gypsum body.

For example, in certain embodiments of the building surface product as otherwise described herein, the first fastener extends through the reinforcing layer and into the front layer. For example, as shown in FIGS. 1C and 1D, first fastener 140 of building surface product 100 penetrates rear surface 109 of panel 102 and extends entirely through reinforcing layer 114 and into front layer 113. First fastener 140 extends only partially into front layer 113 and thus, the end of first fastener 140 is disposed within the front layer 113. Accordingly, first fastener 140 is not visible on the front surface 108 of panel 102. In other embodiments, the first fastener extends through both the front layer and the reinforcing layer to the front surface of the panel. Still, in other embodiments, the first fastener extends only partially through the reinforcing layer and does not extend to the front layer.

In certain embodiments of the building surface product as otherwise described herein, the reinforcing layer includes a first section along a first edge of the panel, and the first section is disposed behind the front layer along the first edge. For example, reinforcing layer 114 of panel 102 includes a first section 115 along a first edge 116 of panel 102, as shown in FIG. 1A. Specifically, first section 115 of reinforcing layer 114 extends along the length of panel 102 from first end 106 to second end 107, thereby reinforcing the entire first side 104 of panel 102. In other embodiments, the first section of the reinforcing layer extends across the width of the panel, rather than the length. Moreover, in some embodiments, the first section of the reinforcing layer extends over only a portion of the respective side or end, rather than over its entirety.

In certain embodiments of the building surface product as otherwise described herein, the gypsum body includes a first edge section between the front layer and the first section of the reinforcing layer at the first edge. For example, as shown in FIG. 1D, gypsum body 110 includes a first edge section 150 that is positioned along first edge 116 of panel 102 between front layer 113 and the first section 115 of reinforcing layer 114. Accordingly, first edge section 150 forms the outer surface of panel 102 along first edge 116.

In certain embodiments of the building surface product as otherwise described herein, the front layer has a first tapered face along the first edge, the first section of the reinforcing layer has a tapered face along the first edge, and the first edge section has a triangular shape including a front face that is adjacent to the first tapered face of the front layer and a rear face that is adjacent to the tapered face of the first section of the reinforcing layer. For example, first edge section 150 of gypsum body 110 has a triangular cross-section with an outer face 151 along first edge 116, a front face 152 that is presented toward front layer 113, and a rear face 153 that is presented toward first section 115 of reinforcing layer 114. To match the shape of first edge section 150, front layer 113 has a first tapered face 154 that is opposes front face 152 of first edge section 150. Likewise, first section 115 of reinforcing layer 114 also has a tapered face 155 that opposes rear face 153 of first edge section 150. In the embodiment of shown in FIGS. 1A-1D, gypsum body 110 has similar edge sections around the perimeter of panel 102. For example, FIG. 1C shows another edge section that runs along end 107 of panel 102 and is positioned between front layer 113 and another part of reinforcing layer 114.

In certain embodiments of the building surface product as otherwise described herein, the front layer, the first edge section, and the first section of the reinforcing layer are formed from a machined and folded gypsum sheet. For example, the configuration shown in FIG. 1D is formed by routing two adjacent V-shaped grooves on one face of a gypsum panel. The space between the two grooves is a triangular ridge of gypsum material that forms first edge section 150. The outer sides of the two grooves form the first tapered face 154 of the front layer 113 and the tapered face 155 of the first section 115 of reinforcing layer 114. The first section 115 of reinforcing layer 114 is then folded over front layer 113 so that the tapered faces 154, 155 oppose the front and rear faces 152, 153 of first edge section 150.

In certain embodiments of the building surface product as otherwise described herein, a continuous facing sheet extends around the first edge so as to cover a rear face of the first section of the reinforcing layer, an outer face of the first edge section, and the front face of the front layer. For example, when the first section 115 of reinforcing layer 114 is folded behind front layer 113, the facing sheet 156 that extended along the original gypsum panel on the face opposite the grooves wraps around the first edge 116 so as to cover the front surface 108 of the gypsum body 110, the outer face 151 of the first edge section 150 and the rear face of the first section 115 of the reinforcing layer 114. In other embodiments, the facing sheet may be applied to the gypsum body after the reinforcing layer is formed over the front layer. Still, in some embodiments, separate facing sheets cover the front layer and reinforcing layer. Further still, in some embodiments, at least some portions of the gypsum body are not covered by a facing sheet.

In certain embodiments of the building surface product as otherwise described herein, an adhesive layer is provided between the first tapered face of the front layer and the front face of the first edge section. Likewise, in certain embodiments, an adhesive layer is provided between the tapered face of the first section of the reinforcing layer and the rear face of the first edge section. For example, in some embodiments, a layer of adhesive may be disposed on either or both of the front face 152 or rear face 153 of first edge section 150 so as to adhere the first edge section 150 to the respective tapered face 154, 155 of the front layer 113 or first section 115 of the reinforcing layer 114. The adhesive layer may help strengthen the edge of the gypsum body 110 and maintain the folded shape of the panel 102.

In certain embodiments of the building surface product as otherwise described herein, an adhesive layer is provided between the between the front layer and the first section of the reinforcing layer. For example, in some embodiments, a layer of adhesive may be disposed on the rear face of the front layer 113 of gypsum body 110 and on the front face of first section 115 of reinforcing layer 114. The adhesive layer may help hold the first section 115 of reinforcing layer 114 against front layer 113 and strengthen the edge of panel 102. In some embodiments, the layer of adhesive is a continuous layer that extends across the entire front surface of the reinforcing layer. In other embodiments, the layer of adhesive may be formed by spots or traces of adhesive on the faces between the two layers. Still, in other embodiments, the layers may be attached to one another in another manner, such as bonding of the gypsum material of the layers to each other or to a material sheet between the two layers.

In certain embodiments of the building surface product as otherwise described herein, the first fastener extends through the adhesive layer provided between the front layer and the first section of the reinforcing layer. For example, in some embodiments, the first fastener may pass through the interface between the front layer and the first section of the reinforcing layer in an area where adhesive is provided between these layers. In some embodiments, the attachment of the first fastener to the panel may be strengthened by the extension of the first fastener through the adhesive. On the other hand, in some embodiments, the first fastener extends through the interface between the front layer and the first section of the reinforcing layer in an area where there is no adhesive positioned between the two layers of the gypsum body.

In certain embodiments of the building surface product as otherwise described herein, a pair of facing sheets are provided between the front layer and the first section of the reinforcing layer. For example, in gypsum body 110 of panel 102 a first intermediate facing sheet 157 is secured to the rear face of front layer 113 and a second intermediate facing sheet 157 is secured to the front face of first section 115 of reinforcing layer 114. Each of the intermediate facing sheets 157, 158 can help increase the strength of the corresponding layer 113, 114 of gypsum body 110. Moreover, the intermediate facing sheets 157, 158 may also help secure the first fastener 140 in the gypsum body 110.

In certain embodiments of the building surface product as otherwise described herein, the reinforcing layer extends around a perimeter of the panel. For example, in certain embodiments, the reinforcing layer includes a section along each edge of the panel. Moreover, in some embodiments, the gypsum body includes an edge section along each edge of the panel between the front layer and respective section of the reinforcing layer. For example, reinforcing layer 114 of panel 102 is formed by four sections positioned around the perimeter of the panel. The four sections of reinforcing layer 114 cooperate using miter joints to form a frame around the perimeter of panel 102. In other embodiments, the reinforcing layer is formed by another number of sections. For example, in some embodiments, the reinforcing layer is formed by two sections along the sides or ends of the panel. In other embodiments, the reinforcing layer is formed by more sections. Further, in some embodiments, the reinforcing layer is formed by a single section that is folded behind the reinforcing layer. For example, in some embodiments, the reinforcing layer is formed by a single section that extends over the entire front layer of the panel.

Figure 3:
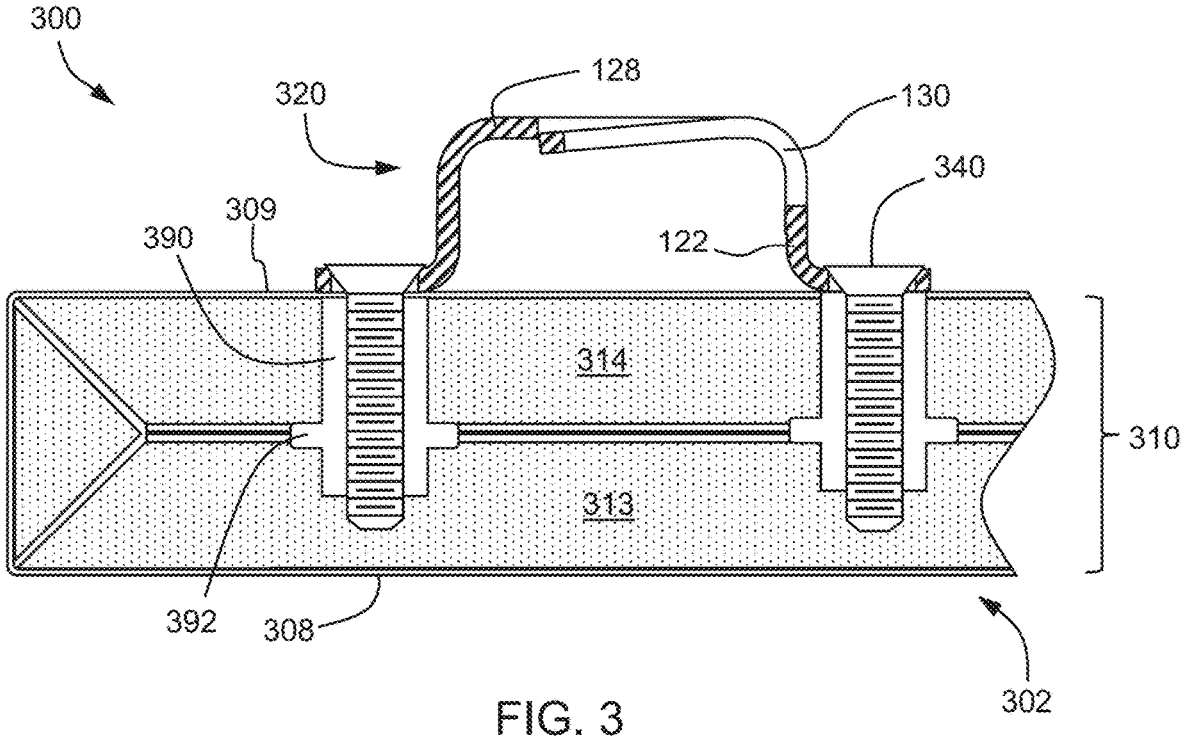
FIG. 3 is a schematic cross-section view of a portion of a building surface product according to another embodiment of the disclosure.

In certain embodiments of the building surface product as otherwise described herein, the panel includes a first receiver sleeve and the first fastener extends into the first receiver sleeve. Such an embodiment is shown in FIG. 3. Building surface product 300 includes a panel 302 with a gypsum body 310 formed by a front layer 313 and a reinforcing layer 314. A first attachment clip 320 is secured to a rear surface 309 of panel 302 using two fasteners including a first fastener 340. The panel 302 includes a first receiver sleeve 390 that is held in the gypsum body 310 and secures the first fastener 340 to the panel 302.

In certain embodiments of the building surface product as otherwise described herein, the first receiver sleeve extends through the reinforcing layer and into the front layer. For example, in panel 302, first receiver sleeve 390 extends from rear surface 309 entirely through reinforcing layer 314 and into front layer 313. In some embodiments, the receiver sleeves extend to the front surface of the panel. In other embodiments, the receiver sleeves extend through the reinforcing layer and do not extend into the front layer. For example, first receiver sleeve 390 extends partially through front layer 313 but not all the way to front surface 308. On the other hand, in some embodiments, the receiver sleeves extend partially into the reinforcing layer and do not extend at all into the front layer. Moreover, in some embodiments, the receiver sleeves extend outward from the interface between the front layer and reinforcing layer but do not reach the front surface or the rear surface.

In certain embodiments of the building surface product as otherwise described herein, the first receiver sleeve includes a threaded interior surface configured to engage the first fastener. For example, in some embodiments, the first fastener is a threaded fastener and the first receiver sleeve includes a complementary thread to receive the first fastener. Such a threaded engagement may help secure the first fastener in the panel.

In certain embodiments of the building surface product as otherwise described herein, the first receiver sleeve includes an external flange disposed between the front layer and the reinforcing layer. For example, first receiver sleeve 390 of building surface product 300 includes an external flange 392 that extends radially outward from an axis of the receiver sleeve. The external flange 392 is positioned between the front layer 313 and the rear layer 314 so as to prevent the receiver sleeve 392 from separating from the panel 302.

In certain embodiments of the building surface product as otherwise described herein, the panel includes a first aperture extending through the gypsum body from the front surface to the rear surface, and the first fastener extends through the first aperture.

Figure 2A:
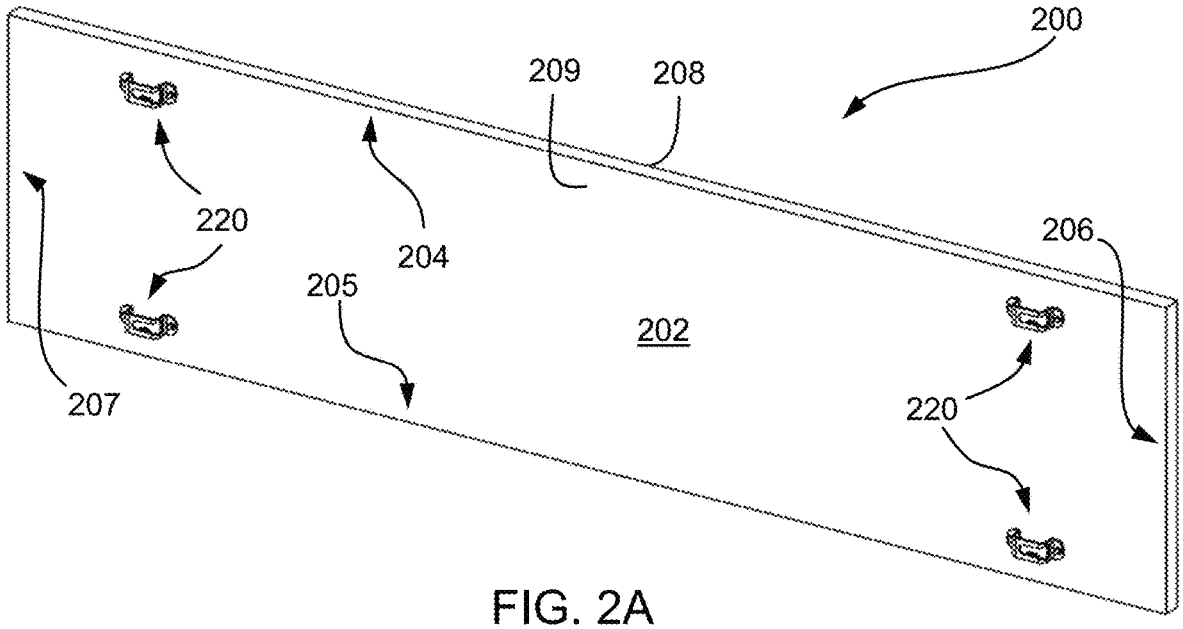
FIG. 2A is a schematic perspective view of a building surface product according to another embodiment of the disclosure.
Figure 2B:
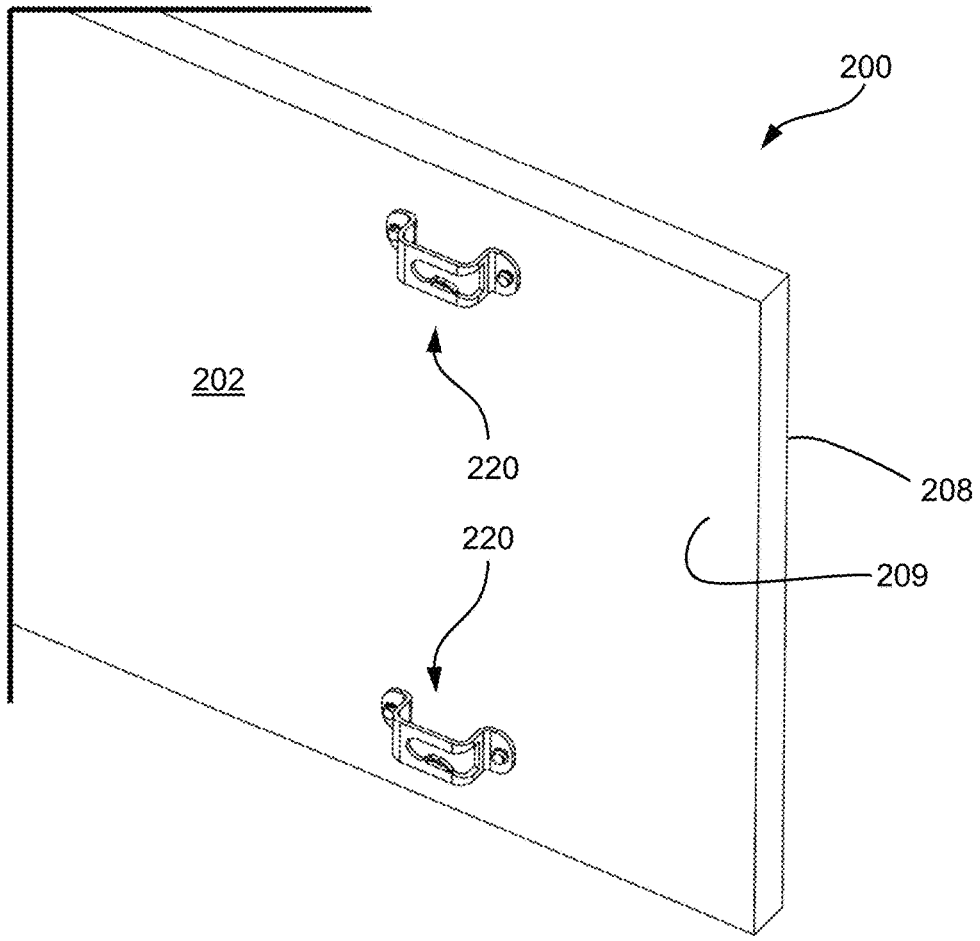
FIG. 2B is a schematic perspective view of a portion of the building surface product of FIG. 2A.
Figure 2C:
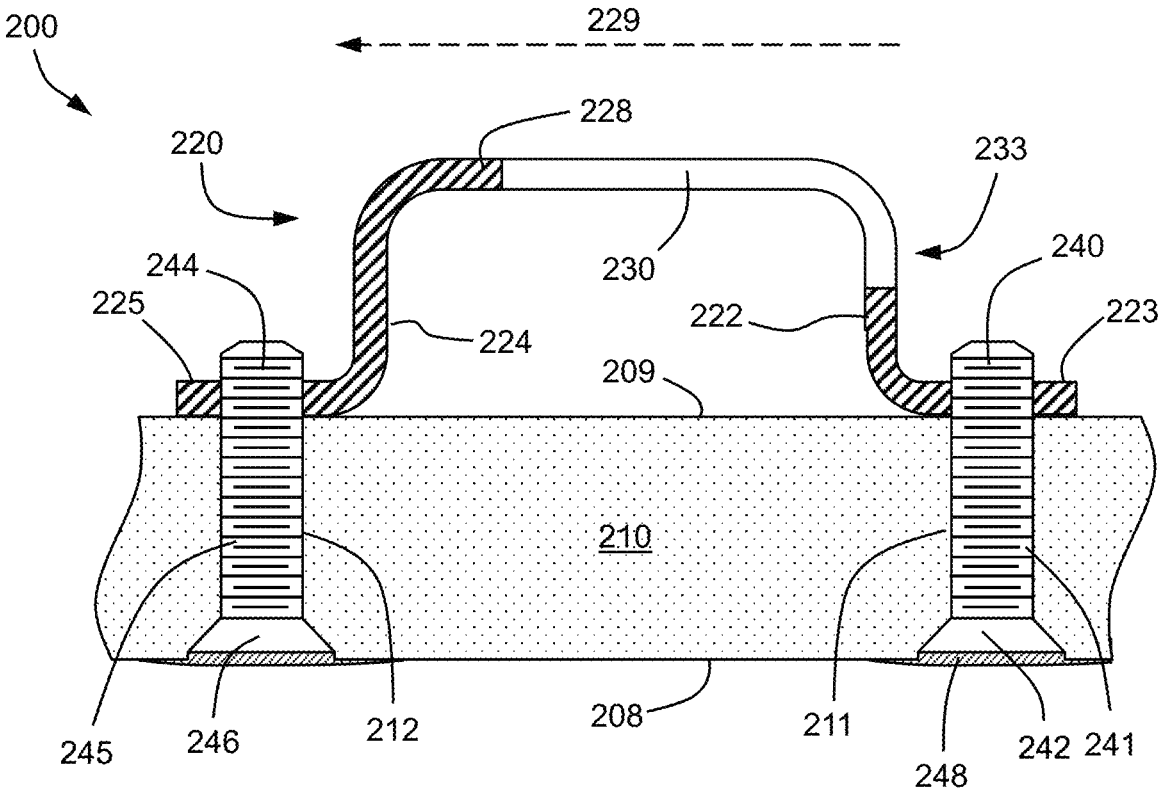
FIG. 2C is a schematic cross-sectional view of a portion of the building surface product of FIG. 2A.

Such an embodiment is shown in FIGS. 2A-2C. Building surface product 200 includes a planar panel 202 in the form of a rectangle that has a first side 204, a second side 205, a first end 206, a second end 207, a front surface 208, and a rear surface 109. Further panel 202 includes a gypsum body 210 (see FIG. 2C) that is disposed between the front surface 208 and the rear surface 209. Building surface product 200 also includes a number of attachment clips 220 secured to rear surface 209 of panel 202. FIG. 2B shows greater detail of two of the attachment clips 220 secured to rear surface 209 of panel 202, and FIG. 2C shows a cross-sectional view of a first attachment clip 220 secured to the rear surface 209 of panel 202.

As illustrated in FIG. 2C, first attachment clip 220 includes a first leg 222 extending outward from rear surface 209 of panel 202 and a retaining flange 228 coupled to first leg 222. The retaining flange 228 extends in a first direction 229 over the rear surface 209 of panel 202. The first attachment clip 220 is secured to panel 202 by a first fastener 240 that penetrates rear surface 209 and extends into gypsum body 210. The term aperture, as used herein, refers to an opening that extends through the entire thickness of gypsum core. For example, in panel 202 the first aperture 211 extends through the entire gypsum body 210 and from front surface 208 to rear surface 209. In other embodiments, the fasteners securing the attachment clips to the panel may extend partially through the gypsum body, for example, in a blind hole, such as in panel 102, shown in FIGS. 1A-1D.

In certain embodiments of the building surface product as otherwise described herein, the first attachment clip is one of a plurality of attachment clips secured to the rear surface of the panel. For example, building surface product 100 includes six attachment clips 120 secured to the rear surface 109 of panel 102. Further, in some embodiments, all of the attachment clips have the same configuration, such as in building surface product 100. For example, in some embodiments, each of the plurality of attachment clips includes a respective first leg extending outward from the rear surface and a respective retaining flange coupled to the first leg, where the first leg of each attachment clip is attached to a respective first fastener that extends through a respective aperture in the gypsum body of the panel.

In other embodiments, the attachment clips have different configurations. For example, in some embodiments, the attachment clips at one end of the panel have a different configuration than attachment clips at the other end. Likewise in some embodiments, the attachment clips at the top of the panel have a different configuration than those at the bottom. Further, while building surface product 100 includes six attachment clips 120, as shown in FIG. 1A, in other embodiments, the building surface product may include more or fewer attachment clips. For example, in some embodiments, the building surface product includes several columns of attachment clips across the width of the panel. Likewise, in some embodiments, the building surface product includes several rows of attachment clips over the height of the panel. Further, in some embodiments, the building surface product includes a single attachment clip.

In certain embodiments of the building surface product as otherwise described herein, the first attachment clip includes a second leg extending outward from the rear surface of the panel and coupled to the retaining flange and the building surface product includes a second fastener that penetrates the rear surface of the panel and is attached to the second leg so as to further secure the attachment clip to the panel. For example, as shown in FIGS. 1C and 1E, first attachment clip 120 of building surface product 100 includes a second leg 124 that extends outward from rear surface 109 in a similar manner to first leg 122. Like first leg 122, second leg 124 is also coupled to retaining flange 128. The second leg 124 of attachment clip 120 is secured to panel 102 by a second fastener 144 that penetrates the rear surface 109 of panel 102.

In certain embodiments of the building surface product as otherwise described herein, the first and second legs are arranged in a line that extends in the first direction, and where a depth of the slot extends in the first direction. For example, as shown in FIGS. 1C and 1E, first leg 122 and second leg 124 are arranged with respect to one another in a line that extends in the first direction 129. Likewise, the depth direction of slot 130 within retaining flange 128 is also aligned with the first direction 129. In other words, as a post is inserted into slot 130 the post will travel in the first direction as it moves toward the closed end of slot 130.

In other embodiments the depth direction of the slot is oriented in a different direction. For example, in some embodiments, the depth direction of the slot is perpendicular to the direction in which the first and second legs are arranged. In other words, in some embodiments, the slot is oriented such that a post being inserted into the slot crosses a line between the two legs as opposed to traveling in the direction of such a line.

Figure 4:
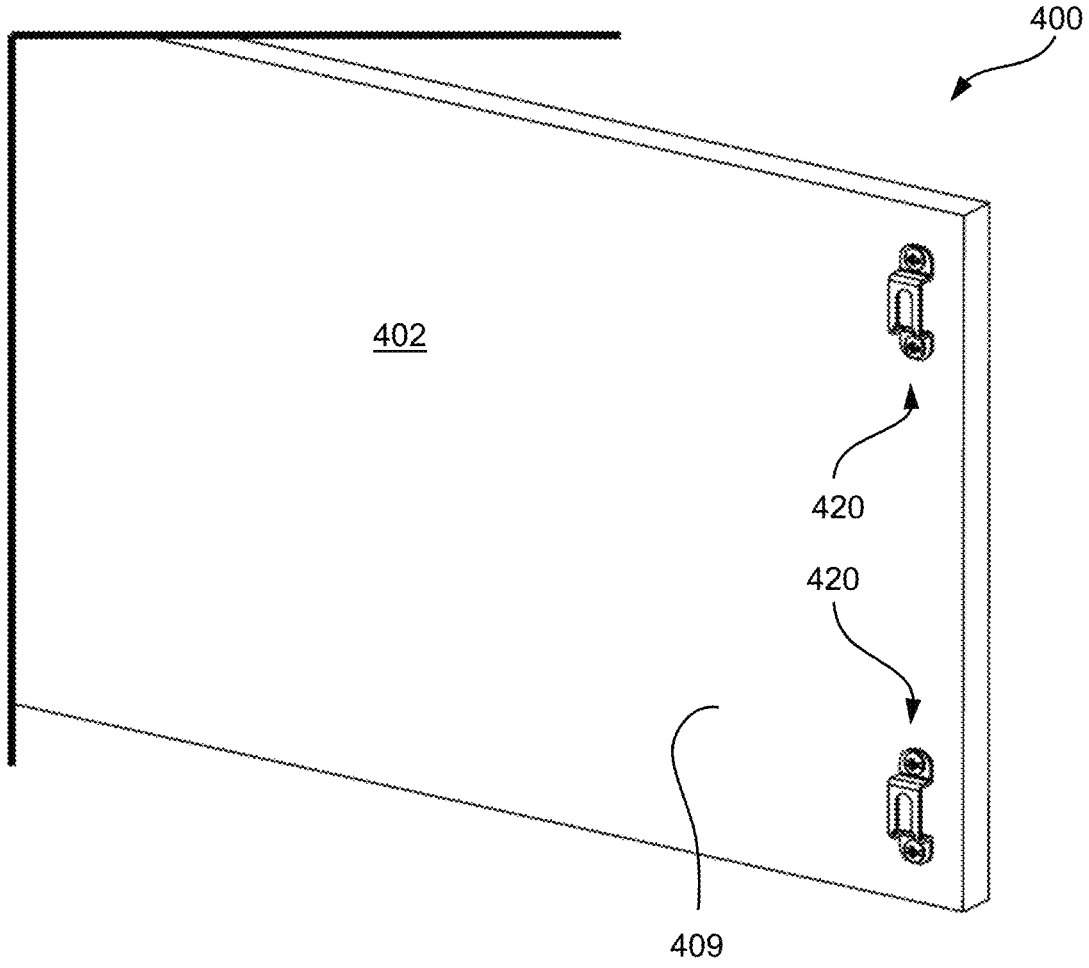
FIG. 4 is a schematic perspective view of a portion of a building surface product according to another embodiment of the disclosure.

In some embodiments of the building surface product, the depth direction of the slot of the attachment clip is oriented so that the post is inserted into the slot by a horizontal movement of the building surface product. For example, as illustrated by FIG. 1B, attachment clips 120 of building surface product 100 are oriented so that a post may be inserted by moving the building surface product 100 laterally in view of the depth direction of the slot being horizontal. In other embodiments, the depth direction of the slot of the attachment clip is oriented so that the post is inserted into the slot by a vertical movement of the building surface product. Such an embodiment is shown in FIG. 4. Building surface product 400 includes a panel 402 and attachment clips 420 secured to a rear surface 409 of the panel 402. The attachment clips 420 are oriented so that a post may be inserted into the slot of the attachment clips 420 by moving building surface product 400 downward.

Further, in some embodiments, the depth direction of the slot of the attachment clip is aligned with the longer dimension of the panel. For example, in building surface product 100, the depth of slot 130 extends in the same direction as the longer dimension of panel 102. In other embodiments, the depth direction of the slot is aligned with the shorter dimension of the panel. For example, in building surface product 400, the depth of the slot in the attachment clips 420 extends in a direction that is perpendicular to the longer dimension of panel 402.

In certain embodiments of the building surface product as otherwise described herein, the first leg of the attachment clip includes a first foot that lies against the rear surface of the panel, and the first fastener penetrates the first foot so as to attach the first fastener to the first leg. For example, as shown in FIGS. 1C and 1E, first leg 122 of attachment clip 120 includes a first foot 123 that lies against rear surface 109. In order to secure attachment clip 120 to panel 102, first fastener 140 penetrates foot 123 and holds foot 123 against rear surface 109. Second leg 124 has a similar configuration and includes a second foot 125 that lies against rear surface 109 and a second fastener 144 penetrates second foot 125. In building surface product 100, the fasteners 140, 144 engage the respective feet 123, 125 using threads included thereon, which hold the fasteners in place. In other embodiments, the fasteners may be secured to the feet using a nut or other device, or by deforming the end of the fasteners so they are not removable from the feet, for example, in the manner of a rivet.

In some embodiments, each fastener passes through the entire thickness of the body of the panel. For example, first fastener 240 and second fastener 244 of building surface product 200 each pass through the body 210 of panel 202 from the front face 208. In other embodiments, each fastener is inserted to an intermediate depth in the panel such that the end of the fastener is embedded in the panel. For example, in some embodiments, each faster is inserted to a desired depth from the rear surface of the panel and does not pass through to the front face, such as in building surface product 100, shown in FIGS. 1A-1D.

Figure 8A:
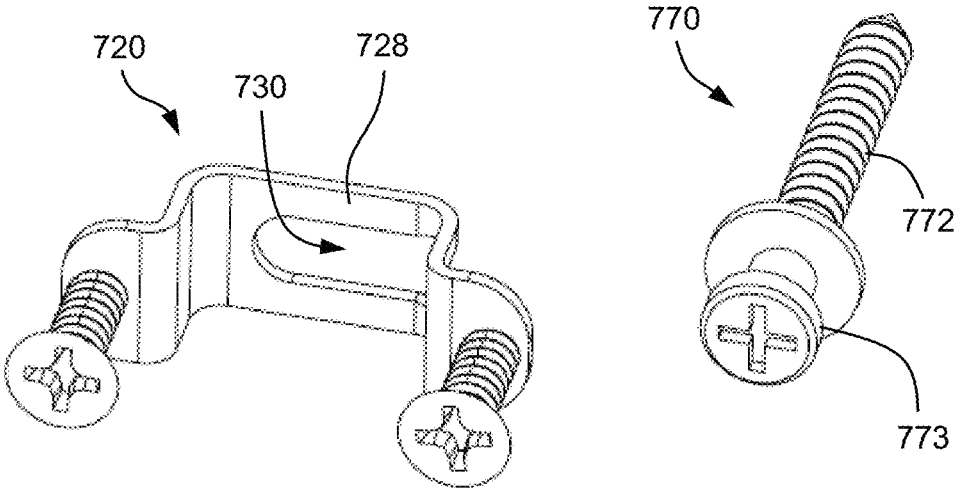
FIG. 8A is a schematic perspective view of the attachment clip and post of the building surface system of FIG. 7 in a disengaged position.
Figure 8B:
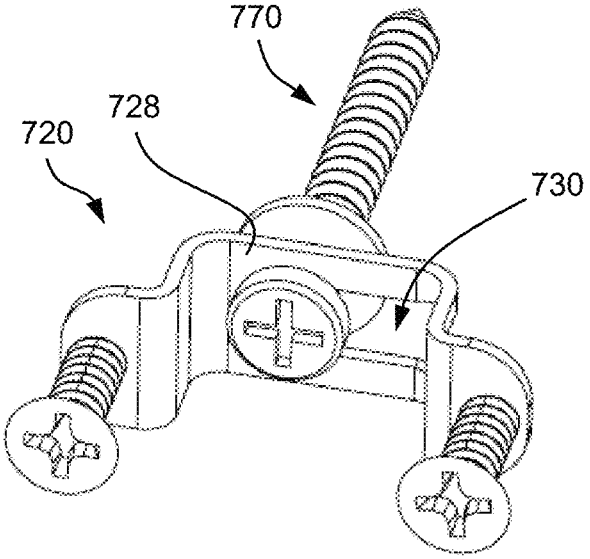
FIG. 8B is a schematic perspective view of the attachment clip and post of the building surface system of FIG. 7 in an assembled position.

In certain embodiments of the building surface product as otherwise described herein, the retaining flange includes a first edge on one side of the slot and a second edge on the other side of the slot, and the first and second edges are configured to abut an outwardly extending lip of the post. For example, as shown in FIG. 1E, retaining flange 128 of attachment clip 120 includes a first edge 131 on the upper side of slot 130 and a second edge 132 on the lower side of slot 130. When a post is inserted into slot 130, these edges 131, 132, are configured to abut an outwardly extending lip, such as a head of the post, in order to prevent the post from being removed from the slot along the axial direction of the post. FIGS. 8A and 8B show the engagement of the post with attachment clip 120 in more detail and are described further below.

In certain embodiments of the building surface product as otherwise described herein, the slot widens to an opening in the first leg, and wherein a width of the opening is greater than a width of the slot. For example, as shown in FIG. 1E, attachment clip 120 includes an opening 133 in first leg 122 that is connected to slot 130. The width of opening 133 is wider than that of slot 130, which allows the head or lip of the post to enter slot 130 via opening 133, but subsequently be retained by first edge 131 and second edge 132 once the post is an assembled position within slot 130.

Figure 10:
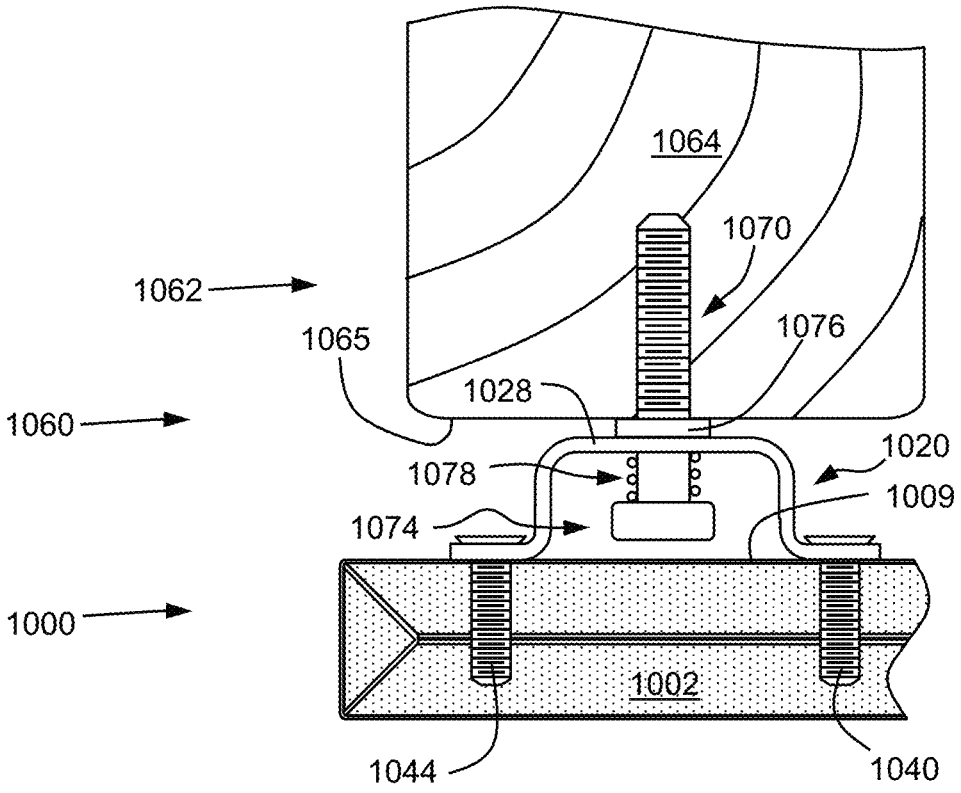
FIG. 10 is a schematic cross-sectional view of a portion of a building surface system according to another embodiment of the disclosure.

In certain embodiments of the building surface product as otherwise described herein, the first direction is parallel to the plane of the panel. For example, as shown in FIG. 10, the direction in which the retaining flange 128 extends over rear surface 109 of panel 102 is parallel to the plane of panel 102.

In certain embodiments of the building surface product as otherwise described herein, the retaining flange is formed as a plate. For example, retaining flange 128, as shown in FIG. 1E, is in the form of a plate with slot 130 cut out of the plate. In other embodiments, the retaining flange has another form. For example, in some embodiments, the retaining flange includes a pair of bars or a U-shaped bar that forms the slot.

In certain embodiments of the building surface product as otherwise described herein, the plate is parallel to the panel. For example, as shown in FIGS. 1C and 1E, the plate configuration of retaining flange 128 extends over rear surface 109 of panel 102 such that retaining flange 128 is parallel to rear surface 109.

In certain embodiments of the building surface product as otherwise described herein, the first attachment clip is formed from a bent metal sheet. The term metal sheet, as used herein, is not limited to any particular thickness and may include materials conventionally referred to as metal foil, sheet metal, metal plate, or metal strips. The metal sheet may be formed of aluminum, steel, iron, or another metal. For example, as depicted in FIGS. 1A-1E, first attachment clip 120 is formed as a metal part that is punched from a metal sheet and bent into the shape shown. For example, the attachment clip 120 is bent at two locations to form the feet 123, 125 that extend outward from legs 122, 124. Likewise, the attachment clip 120 also includes bends between the legs 122, 124 and retaining flange 128. In other embodiments, the attachment clip is made of another material, such as a polymer material, a composite material of metal and plastic, or another material. Moreover, in some embodiments the attachment clip is formed by another method, such as casting, molding, extrusion, additive manufacturing or another method.

In certain embodiments of the building surface product as otherwise described herein, the first fastener includes a threaded shaft. For example, in some embodiments, the first fastener is a bolt or a screw. In other embodiments, the first fastener may have another form. For example, in some embodiments, the first fastener is formed as a rivet. In other embodiments, the first fastener is formed as a clevis pin with a hole for a corresponding cotter pin. Other types of fasteners are also possible.

Figure 5:
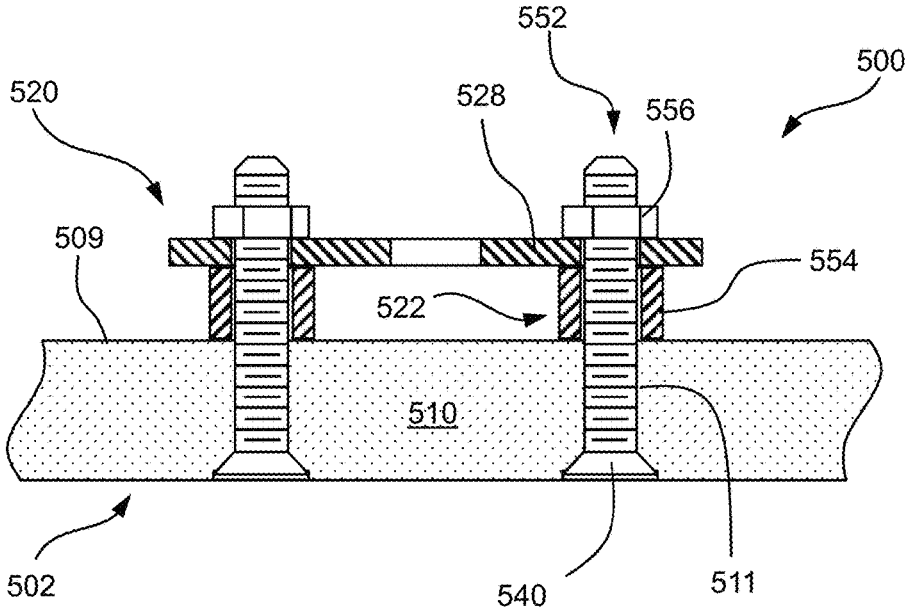
FIG. 5 is a schematic cross-sectional view of a portion of a building surface product according to another embodiment of the disclosure.

In some embodiments, a single component forms both the first fastener and the first leg of the attachment clip. Such an embodiment is shown in FIG. 5. Building surface product 500 includes a panel 502 with a threaded bolt 552 passing therethrough. The threaded bolt 552 forms both a first fastener 540 that extends through a first aperture 511 in the gypsum body 510 of panel 502. Threaded bolt 552 also forms a first leg 522 of attachment clip 520. In combination with a spacer 554, first leg 522 formed by threaded bolt 552 holds retaining flange 528 at a distance from rear surface 509 of panel 502. Retaining flange 528 is in the form of a plate that is secured on the threaded bolt 552 using a nut 556.

Figure 2D:
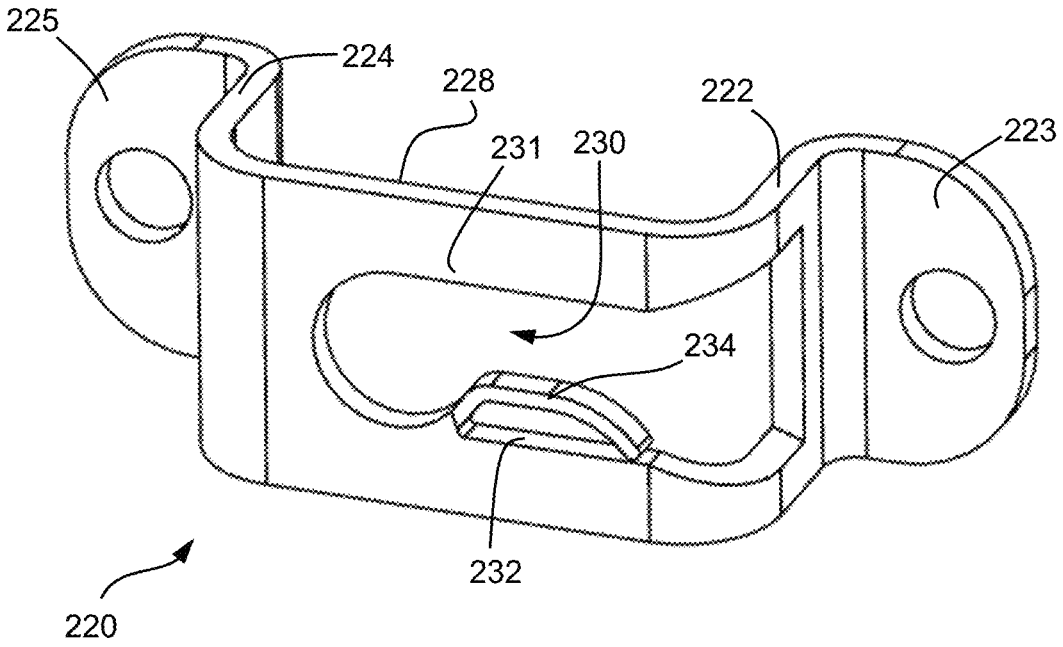
FIG. 2D is a detailed schematic perspective view of an attachment clip of the building surface product of FIG. 2A.

In certain embodiments of the building surface product as otherwise described herein, the first attachment clip includes a spring catch that extends into the slot and is configured to secure the post in the slot. The spring catch, as the term is used herein, describes a resilient element that extends into the slot and is configured to deform in response to the force of the post being inserted into the slot. Once the post is in place in an assembled position, the spring catch presents a hindrance for the post to be removed again. Accordingly, the post will stay in place until the force needed to move the spring catch is applied again to the post. Such an attachment clip is shown in FIG. 2D, Attachment clip 220 includes a first leg 222 that extends from a first foot 223 and a second leg 224 that extends from a second foot 225. The first and second feet 223, 225 are configured to mount to a panel and the first and second legs 222, 224 hold a retaining flange 228 at a distance from the panel surface. The retaining flange includes a slot 230 including a first edge 231 and a second edge 232 that are configured to retain a post in the slot. Further, attachment clip 220 includes a spring catch 234 that extends from second edge 232 into slot 230. As the post is moved into slot 230, the spring catch 234 is configured to deform in response to the force of pushing the post into the slot, which allows the post to pass spring catch 234. Once the post is in the assembled position toward the closed end of slot 230, the spring catch 234 holds the post in place. In order to remove the post from slot 230, a force needs to again be exerted on spring catch 234 to deform the spring catch 234 and allow the post to pass.

In some embodiments, the spring catch is formed in a single integral piece with the retaining flange. For example, spring catch 234 is a part that is cut from the metal sheet that forms attachment clip 220. In other embodiments, the spring catch is a separate component that is coupled to the retaining flange. For example, in some embodiments the spring catch is a separate element that is hooked onto one edge of the retaining flange.

In other embodiments the attachment clip includes other features to retain the post within the slot. For example, in some embodiments, the slot curves upward at the closed end. As the building surface product is slid from the disengaged to the assembled position so as to move the post into the slot, the building surface product drops slightly as the post moves into the upward section of the slot. Accordingly, in order to remove the post from the slot, the building surface product is lifted slightly, and the need to lift the building surface product to remove the post from the attachment clip helps retain the building surface product in place with the post at the closed end of the slot.

In certain embodiments of the building surface product as otherwise described herein, the first fastener extends through the gypsum body and a front end of the first fastener includes a head that is larger than the first aperture so as to hold the first fastener within the first aperture. For example, as shown in FIG. 2C, first fastener 240 includes a threaded cylindrical shaft 241 with a head 242 at the front end of the fastener that has a larger diameter than the shaft 241. Further, the head 242 has a larger diameter than first aperture 211 in core 210, which prevents first fastener 240 from passing through first aperture 211 to the rear surface 209 of panel 202. Likewise, the attachment of first fastener 240 to attachment clip 220 also prevents first fastener 240 from retreating from first aperture 211 toward front face 208. In some embodiments, the front surface of the first fastener has a cavity for a mating tool, such as a screw driver, for inserting the first fastener into the panel. Second fastener 244 has a similar configuration to first fastener 240 and includes a threaded cylindrical shaft 245 and an enlarged head 246 that prevents second fastener 244 from extending all the way through second aperture 212.

In certain embodiments of the building surface product as otherwise described herein, a front end of the first fastener is covered with joint compound. Further, in some embodiments, the front end of the first fastener is covered with paint. Moreover, in some embodiments, the front end of the first fastener is covered with a layer of joint compound and then subsequently with a layer of paint, so that the front surface of the building surface product has a finished surface. Advantageously, because the building surface product is held in place on the support structure using attachment clips, the application of joint compound and paint may be carried out in a manufacturing facility, where specialized machinery can apply the joint compound and paint. Accordingly, the application of joint compound and paint at a job site can be avoided, resulting in a finished product that is significantly easier and faster to install.

For example, as shown in FIG. 2C, the front end of first fastener 240 at the front face 208 of panel 202 is covered by joint compound 248. Moreover, the joint compound 248 fills a small section of aperture 211 resulting from first fastener 240 being driven into core 210 slightly past front face 208. The joint compound 248 and front face 208 of panel 202 are also covered in paint, to present a smooth, finished surface.

In some embodiments, the panel includes a gypsum body. In other embodiments, the panel is formed from another material. For example, in some embodiments, the panel is constructed of wood or a polymer material. In some embodiments, building surface products including a panel of wood or polymer may include attachment clips that are fastened to the rear surface of the panel without passing all the way through the panel.

In certain embodiments of the building surface product as otherwise described herein, the gypsum body comprises a reinforced gypsum material. The use of a reinforced gypsum material can enhance the connection between the panel and the fasteners extending therethrough. Moreover, the use of a reinforced gypsum material can also provide extra stability for the panel in the vicinity of the fasteners. This added stability can enable the use of a broader range of fasteners to hold the attachment clips to the rear surface of the panel. For example, in some embodiments, the gypsum body includes at least 1% by weight polymer. Reference to the weight percentage of a component of the gypsum body, as used herein, refers to the weight after the gypsum has set. In certain embodiments, the polymer includes starch and/or polyvinyl acetate.

In certain embodiments of the interlocking building surface product as otherwise described herein, the gypsum body includes at least 1% by weight of reinforcing fibers. For example, in some embodiments, the gypsum body includes glass fibers. Further, in some embodiments, the gypsum panel includes cellulose-based fibers. Moreover, in some embodiments, the gypsum panel includes polyethylene, polypropylene or polyester fibers. Various embodiments of the building surface product include different combinations of the aforementioned fibers in the gypsum panel.

In some embodiments, the gypsum body includes one or more additives, such as biocides, hydrophobic additives, and fire resistance additives.

In certain embodiments of the building surface product as otherwise described herein, the panel is rectangular. For example, as shown in FIG. 1A, the shape of building surface product 100 is governed by panel 102 which has a rectangular form. In particular, the first edge 116 along first side 104 is parallel to the edge along second side 105 and the two edges run across the width of panel 102. Likewise, the edge at first end 106 is parallel to edge at second end 107. Moreover, the sides and ends of panel 102 are perpendicular to one another such that the shape of panel 102 is that of a rectangle. In other embodiments, the building surface product has another shape. For example, in some embodiments, the building surface product is formed as a trapezoid, triangle, or other polygon.

Figure 6:
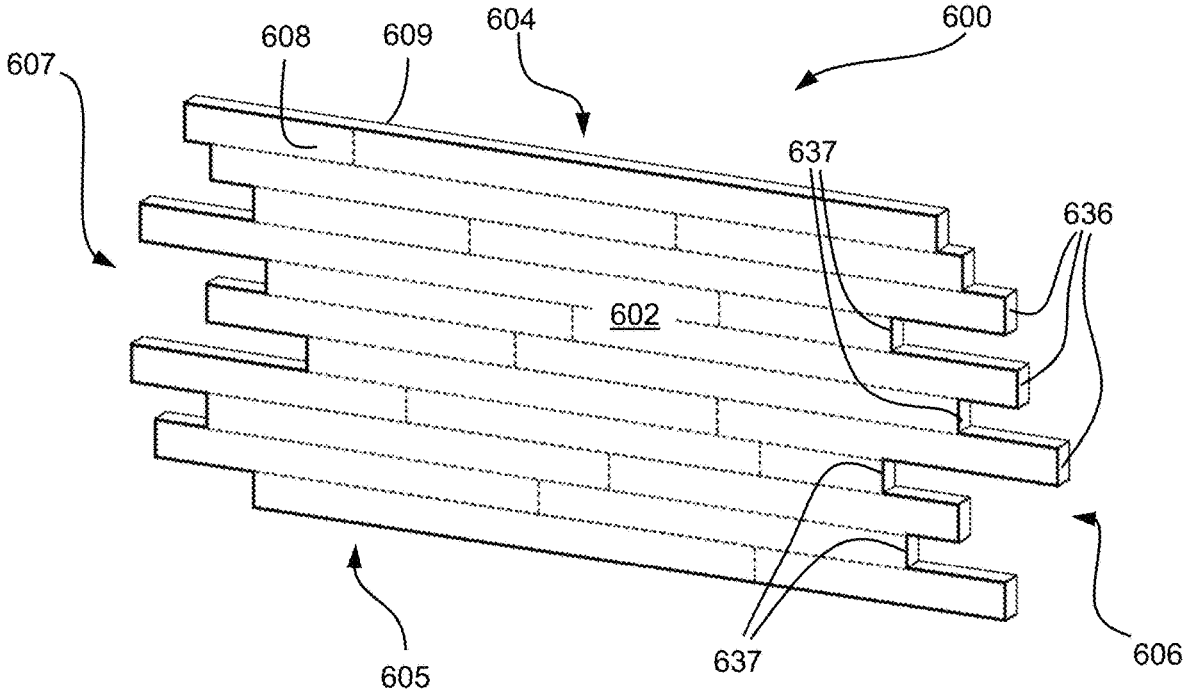
FIG. 6 is a schematic perspective view of a building surface product according to another embodiment of the disclosure.

Further, in certain embodiments of the building surface product as otherwise described herein, at least one of the first side, second side, first end, and second end includes a non-linear edge. For example, in some embodiments, the non-linear edge includes a plurality of projections and indentations. Such a building surface product is shown in FIG. 6. Building surface product 600 includes a panel 602 including a first side 604, a second side 605, a first end 606, a second end 607, a front surface 608 and a rear surface 609. Further, like the other building surface products, building surface product 600 includes attachment clips on the rear surface 609 that are obscured from view in FIG. 6. Moreover, the edges along first end 606 and second end 607 are non-linear. In particular, the edges along first end 606 and second end 607 include a plurality of projections 636 and indentations 637. These projections 636 and indentations 637 help provide a more uniform visual across a building surface constructed using a plurality of products similar to building surface product 600. The projections 636 and indentations 637 obscure the borders between adjacent products. In other embodiments, the non-linear edge may have another configuration and purpose. For example, in some embodiments, the building surface product includes a rounded edge to provide a desired design aesthetic.

In some embodiments the building surface product is configured to form a wall surface or ceiling surface. For example, panel 102 of building surface product 100 is a wall panel. In other embodiments, the building surface product is configured to form a trim or decorative element. For example, in some embodiments, the panel of the building surface product is formed as a trim or decorative component that is attached to a support structure using the attachment clips of the disclosure. For example, in some embodiments the panel is a molding component, such as crown molding at the top of the building surface. In other embodiments, the panel forms a baseboard at the bottom of a building surface. Still in other embodiments, the panel forms corner trim or window trim. Various shapes for such trim configurations are possible. For example, in some embodiments, the trim may be flat, angled or curved. Likewise, such trim can be proud, flush or recessed. Still, in other embodiments the building surface product forms a decorative beam. In some embodiments, the building surface product passes over the middle of a building surface. For example, in some embodiments, the panel of the building surface product forms a chair rail, a batten or has another configuration that passes over the middle of the surface. In some embodiments, the building surface product includes a panel configured as a trim or decorative element and is formed of a polymer or wood and the first fastener extends only partially through the panel.

In certain embodiments of the building surface product as otherwise described herein, the building surface product further includes a facing sheet that lines the gypsum body along at least one of the front surface and the rear surface. In some embodiments, the facing sheet is a paper facing. In other embodiments, the facing sheet includes reinforcing fibers. For example, in some embodiments, the facing sheet includes a fiberglass mat. Further, in some embodiments, the gypsum product of the gypsum panel the building surface product is embedded into the facing sheet.

In certain embodiments of the building surface product as otherwise described herein, the facing sheet surrounds the panel along its length covering both the front surface and the rear surface. For example, in some embodiments, the facing sheet is formed from two distinct sheets that are wrapped around the gypsum panel. The facing sheets may then be attached to one another to surround the panel. In some embodiments, the facing sheets wrap around the panel along its length. The ends of the panel may then either be left uncovered or the facing sheets may also be folded over the ends.

In certain embodiments of the building surface product as otherwise described herein, a width of the panel from the first side to the second side is at least 3 inches, e.g., at least 4 inches, e.g., at least 6 inches. In some embodiments, the width of the panel from the first side to the second side is no more than 6 feet, e.g., no more than 4 feet, e.g., no more than 3 feet. For example, in some embodiments, the width of the panel is in a range from 3 inches to 6 feet, e.g., from 4 inches to 4 feet, e.g., from 6 inches to 3 feet.

In certain embodiments of the building surface product as otherwise described herein, a length of the panel from the first end to the second end is at least 1 foot, e.g., at least 2 feet, e.g., at least 4 feet. In some embodiments, the length of the panel from the first end to the second end is no more than 20 feet, e.g., no more than 15 feet, e.g., no more than 12 feet. For example, in some embodiments, the length of the panel is in a range from 1 foot to 20 feet, e.g., from 2 feet to 15 feet, e.g., from 4 feet to 12 feet.

In certain embodiments of the building surface product as otherwise described herein, a thickness of the panel is at least ⅜ inch, e.g., at least ½ inch, e.g., at least ¾ inch. In some embodiments, the thickness of the panel is no more than 4 inches, e.g., no more than 3 inches, e.g., no more than 2 inches. For example, in some embodiments, the thickness of the panel is in a range from ⅜ inch to 4 inches, e.g., from ½ inch to 3 inches, e.g., from ¾ inch to 2 inches.

In another aspect, the disclosure provides a building surface system including a support structure and a first building surface product according to the disclosure that is secured to the support structure. The support structure includes a plurality of framing elements forming a support frame and a first post extending outward from a front surface of the support frame. To hold the first building surface product against the support structure, the slot in the retaining flange of the first attachment clip of the first building surface product receives the first post of the support structure.

Figure 7:
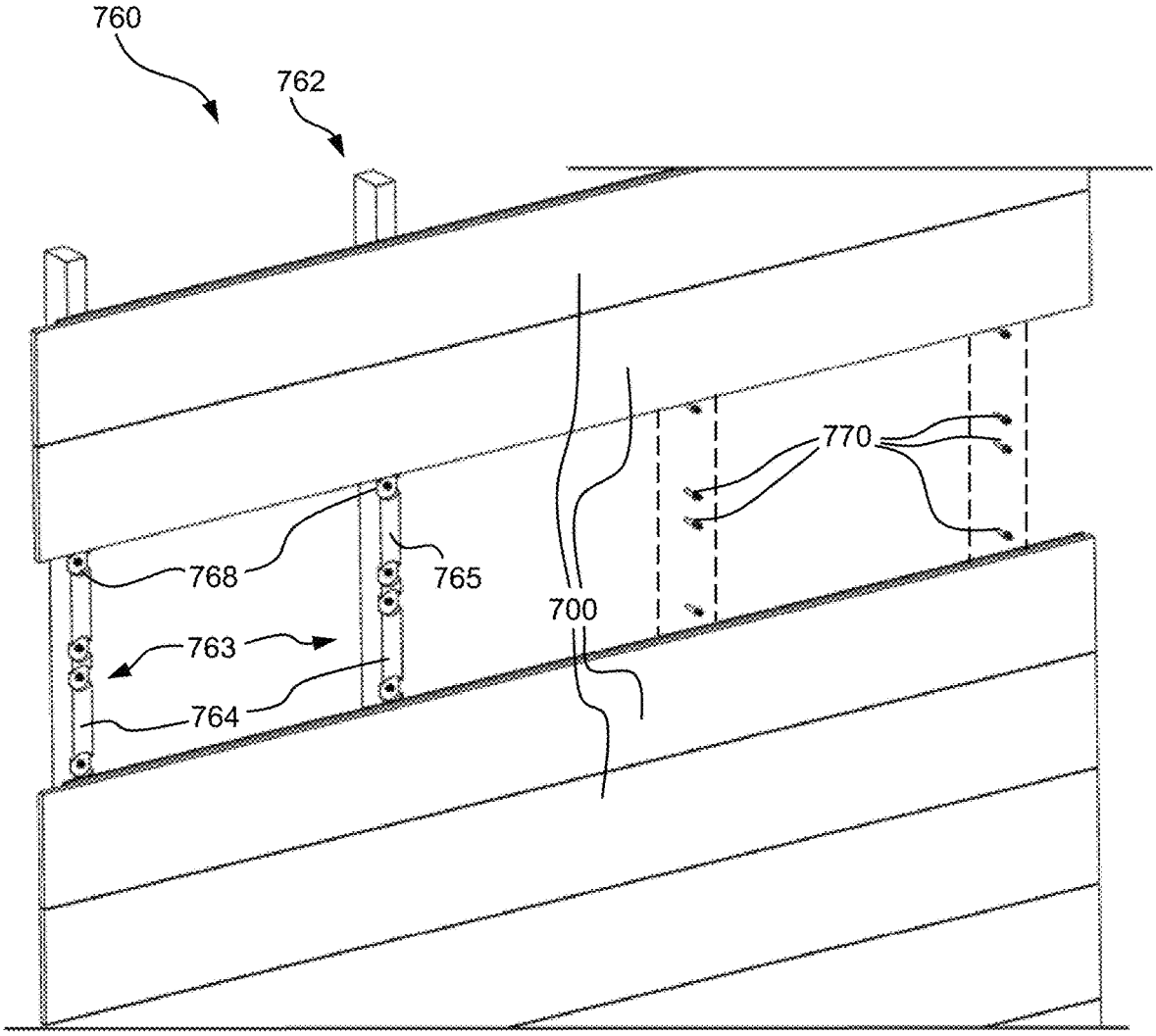
FIG. 7 is a schematic perspective view of a portion of a building surface system according to an embodiment of the disclosure.

Such a building surface system is shown in FIG. 7. Building surface system 760 includes a support structure 762 and a plurality of building surface products 700 secured to the support structure. Support structure 762 includes a support frame 763 that is formed by a plurality of framing elements 764. In some embodiments, the framing elements are wall studs such as in building surface system 760. In other embodiments, the framing elements are ceiling joists or other framing elements.

Building surface system 760 also includes a plurality of posts 770 extending outward from the front surface 765 of support frame 763. The plurality of posts 770 secure the building surface products 700 to the support structure 762 by attaching to the attachment clips 720 of the building surface products 700 (as shown in FIGS. 8A and 8B). Building surface system 760, as shown in FIG. 7, includes locations for two building surface products that have been removed to illustrate the framing elements 764 of support frame 763 of support structure 762 and the posts 770. Likewise, two of the framing elements 764 are represented by dashed outlines so that the posts 770 are more clearly visible in FIG. 7.

FIGS. 8A and 8B illustrate the connection that is made between the first attachment clip 720 of building surface product 700 and the first post 770 of support structure 762 in order to secure the building surface product 700 to the support structure 762. To illustrate the connection clearly, the panel that is attached to first attachment clip 720 and the framing element that is attached to first post 770 are both omitted from FIGS. 8A and 8B.

Figure 9:
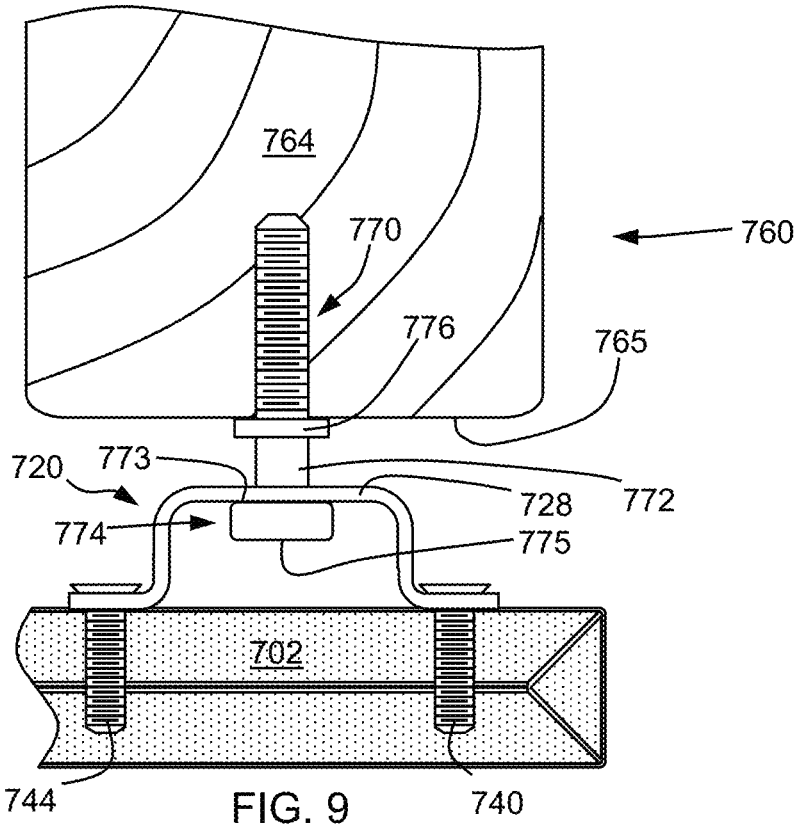
FIG. 9 is a schematic cross-sectional view of a portion of the building surface system of FIG. 7.

FIG. 8A shows the first post 770 and the first attachment clip 720 in a disengaged position where the first post 770 is lined up near the opening of slot 730 of the retaining flange 728 of attachment clip 720, but first post 770 is not yet inserted in the slot. As shown in FIG. 8B, in order to place the first building surface product into the assembled position, the first building surface product is moved so that the first post 770 enters slot 730 of retaining flange 728 and holds the building surface product against the support structure. FIG. 9 shows a cross-sectional view of the first attachment clip 720 secured to the first post 770 in the assembled position, with the panel 702 and framing element 764 also shown.

In certain embodiments of the building surface system as otherwise described herein, the first post includes a shaft and a lip extending radially outward from the shaft, the shaft of the first post is received in the slot in the retaining flange of the first attachment clip, and the lip of the first post is positioned between the retaining flange of the first attachment clip and the rear surface of the panel. For example, as shown in FIGS. 8A and 9, first post 770 includes a shaft 772 that has a lip 773 extending outward from shaft 772. When first post 770 is inserted into slot 730 of retaining flange 728 of first attachment clip 720, the lip 773 is disposed between retaining flange 728 and panel 702, as shown in FIG. 9. Accordingly, lip 773 engages an edge on a side of slot 730 and prevents retaining flange 728, and consequently panel 702, from moving away from framing element 764 of the support structure.

In certain embodiments of the building surface system as otherwise described herein, the lip is formed as a portion of a head on a front end of the first post. For example, as shown in FIG. 9, the lip 773 of first post 770 is disposed on a head 774 positioned at the front end 775 of first post 770.

In certain embodiments of the building surface system as otherwise described herein, the first post includes a shaft that penetrates the front surface of the support frame. For example, as shown in FIG. 9, the shaft 772 of first post 770 includes a threaded portion that is inserted into framing element 764 of the support frame from front surface 765. In other embodiments, the first post is attached to the front surface of the support frame in another manner. For example, in some embodiments, the first post extends from a plate that is attached to the support frame. In other embodiments, the first post is attached to the side of a framing element and extends outward past the front surface of the support frame.

In certain embodiments of the building surface system as otherwise described herein, the first post includes a collar surrounding the shaft that engages the front surface of the support frame. For example, first post 770 includes a collar 776 extending outward from shaft 772 at an intermediate point along the length of first post 770. The collar 776 defines the depth that first post 770 is inserted into the front surface 765 of framing element 764. Accordingly, the lip 773 formed by head 774 is set at a distance from framing element 764, allowing attachment clip 720 to easily engage post 770.

In certain embodiments of the building surface system as otherwise described herein, the first attachment clip includes a spring catch that extends into the slot from a side edge of the slot, and the spring catch is positioned between the first post and the opening of the slot so as to hinder removal of the first post from the slot. For example, as explained in more detail above with respect to FIG. 2C, when a post is inserted into slot 230 of retaining flange 228 of attachment clip 220, the spring catch 234 is positioned between the post and the opening of slot 230 in order to hinder removal of the post from slot 230.

In certain embodiments of the building surface system as otherwise described herein, the system further includes a spring in operative engagement between the first post and the first attachment clip so as to urge the first attachment clip toward a mounted position. In some embodiments, the spring urges the first attachment clip toward the front surface of the support structure. For example, a portion of a building surface system including such a spring is shown in a cross-sectional view in FIG. 10. Building surface system 1060 includes a building surface product 1000 including a panel 1002 with an attachment clip 1020 on a rear surface 1009 of panel 1002. Attachment clip 1020 is secured to panel 1002 using first and second fasteners 1040, 1044 that extend into a gypsum body 1010 of the panel 1002. Support structure 1062 includes a support frame formed by a plurality of framing elements 1064 and a plurality of posts 1070 extending outward from a front surface 1065 of the support frame. Each post 1070 is inserted into a slot in retaining flange 1028 of attachment clip 1020 with a head 1074 of post 1070 positioned between retaining flange 1028 and the rear surface 1009 of panel 1002. Further, a spring 1078 extends around post 1070 urging the head 1074 of post 1070 toward rear surface 1009 and away from retaining flange 1028. Thus, spring 1078 urges the building surface product 1000 toward support structure 1062. Accordingly, the spring 1078 can help retain the building surface product 1000 in a set and desired location with respect to the support structure 1062.

Figure 11:
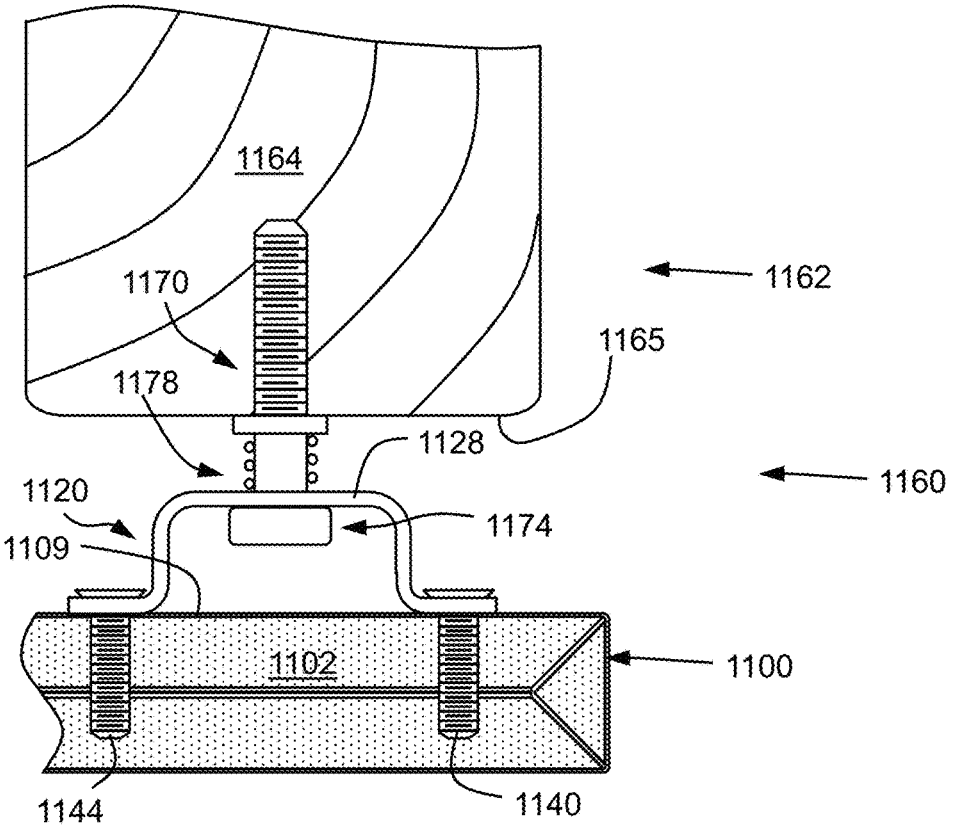
FIG. 11 is a schematic cross-sectional view of a portion of a building surface system according to another embodiment of the disclosure.

In other embodiments, the spring urges the first attachment clip away from the front surface of the support structure. For example, a portion of a building surface system including such a spring is shown in a cross-sectional view in FIG. 11. Building surface system 1160 includes a building surface product 1100 including a panel 1102 with an attachment clip 1120 on a rear surface 1109 of the panel 1102. Two fasteners 1140, 1144 secure attachment clip 1120 to panel 1102. Building surface system 1160 also includes a support structure 1162 with a support frame formed by a plurality of framing elements 1164 and a plurality of posts 1170 extending outward from a front surface 1165 of the support frame. As shown in FIG. 11, each post 1170 is inserted into a slot in retaining flange 1128 of attachment clip 1120 with a head 1174 of post 1170 positioned between retaining flange 1128 and the rear surface 1109 of panel 1102. Further, a spring 1178 extends around post 1170 urging the retaining flange 1128 toward the head 1174 of post 1170 and away from rear surface 1109 of panel 1102. Thus, spring 1178 urges the building surface product 1100 away from support structure 1162 and helps retain the building surface product 1100 in a set and desired location with respect to the support structure 1162.

In certain embodiments of the building surface system as otherwise described herein, the spring is disposed on the first post. For example, spring 1078 of building surface system 1060 and spring 1178 of building surface system 1160 are both wrapped around the respective post 1070, 1170. In other embodiments, the spring is disposed on the first attachment clip. For example, in some embodiments, the spring is formed as a leaf spring element that extends outward perpendicularly to the retaining flange so as to press against the head or the collar of the post.

Figure 12:
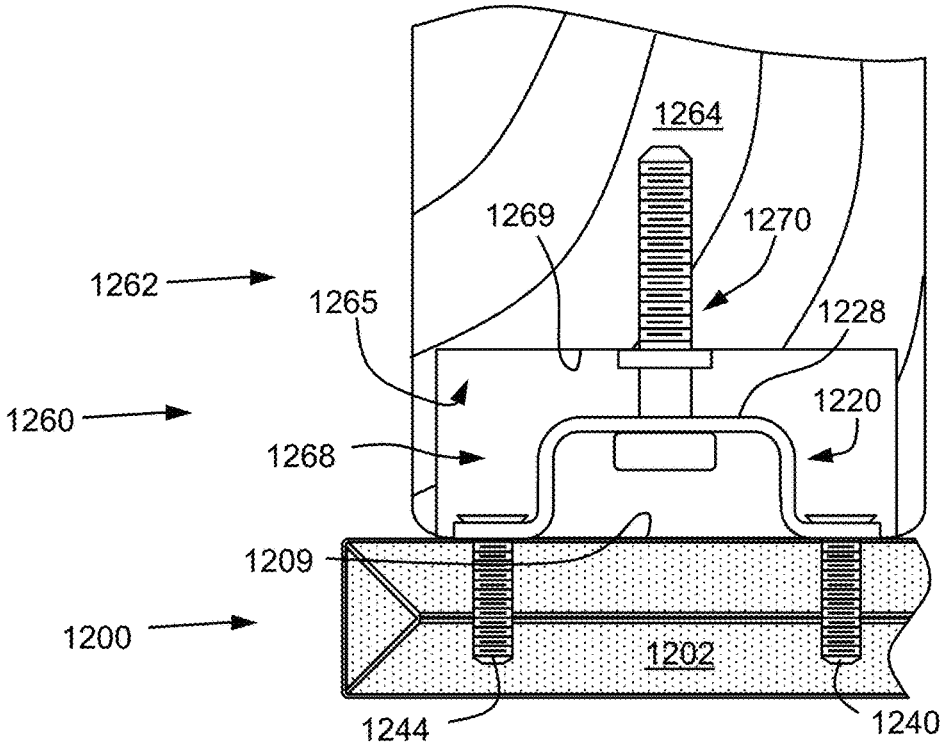
FIG. 12 is a schematic cross-sectional view of a portion of a building surface system according to another embodiment of the disclosure.

In certain embodiments of the building surface system as otherwise described herein, the framing element includes a first notch, the first post extends outward from within the first notch, and a majority of the first attachment clip is positioned within the notch. For example, a portion of a building surface system including such a notch shown in a cross-sectional view in FIG. 12. Building surface system 1260 includes a building surface product 1200 including a panel 1202 with an attachment clip 1220 on a rear surface 1209 of the panel 1202. Two fasteners 1240, 1244 secure attachment clip 1220 to panel 1202. Building surface system 1260 also includes a support structure 1262 with a support frame formed by a plurality of framing elements 1264 and a plurality of posts 1270 extending outward from a front surface 1265 of the support frame. The framing elements 1264 include notches 1268 such that portions of the front surface 1265 of the support frame are provided by base walls 1269 within the notches 1268 that are set back from the rest of the support frame. As shown in FIG. 12, each post 1270 extends outward from a base wall 1269 within the notch 1268. The post 1270 is inserted into a slot in retaining flange 1228 of attachment clip 1220. Due to the depth of the post 1270 within notch 1268, the attachment clip 1220 is also positioned within the depth of notch 1268. As a result, the rear surface 1209 of the panel 1202 is adjacent to much of the front surface 1265 of the support frame. Accordingly, the framing elements 1264 of support structure 1262 provide rear support for panel 1202. Similarly, as shown in FIG. 7, support structure 762 of building surface system 760 includes notches 768 in the framing elements 764, and the posts 770 are disposed within the notches 768.

In certain embodiments of the building surface system as otherwise described herein, the first post is one of a first group of posts extending outward from the front surface of the support frame, wherein the first attachment clip is one of a first group of attachment clips provided on the rear surface of the panel of the first building surface product, and each post of the first group of posts is secured in a respective attachment clip of the first group of attachment clips to hold the first building surface product against the support structure.

For example, in building surface system 760, as shown in FIG. 7, each of the posts 770 is one of a group of posts configured to secure a building surface product to the support structure 762. Each post in the group of posts 770 extends outward from the front surface 765 of the support frame 763 and is configured to cooperate with a corresponding attachment clip on the rear surface of a building surface product.

In certain embodiments of the building surface system as otherwise described herein, the support structure includes a plurality of groups of posts, the first building surface product is one of a plurality of building surface products, and each of the building surface products is secured to a respective group of posts of the support structure. For example, in FIG. 7, two groups of eight posts 770 are visible where respective building surface products are removed from the drawing. Likewise, each of the visible building surface products 700 obscures a respective group of posts that holds the associated building surface product against the support structure 762.

In certain embodiments of the building surface system as otherwise described herein, front ends of the respective posts of the support structure are disposed in a common plane. For example, in some embodiments, as in FIG. 7, each of the posts 770 extends outward from a planar front surface 765 of the support frame 763. By extending the same distance out from the support structure 762, the front end of each post lies in a common plane that is parallel to the front surface 765 of the support frame 763.

Figure 13:
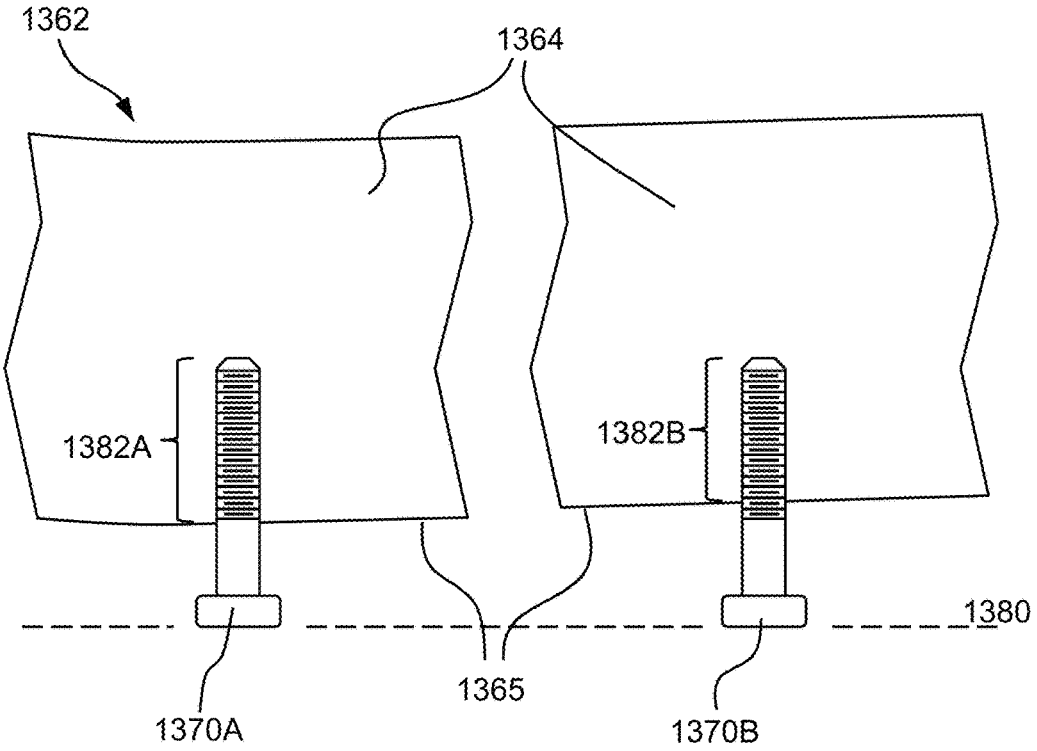
FIG. 13 is a schematic cross-sectional view of a portion of a building surface system according to another embodiment of the disclosure.

However, in other embodiments, the posts are configured to compensate for variations in the front surface of the support frame and provide the posts in a common plane, despite a non-planar front surface of the support frame. For example, in certain embodiments of the building surface system as otherwise described herein, the posts of the support structure penetrate the support frame to different depths so that the front ends thereof are disposed in the common plane. A section of such a configuration is illustrated in FIG. 13. Support structure 1362 includes a support frame with a framing element 1364 that has a slight curvature along front surface 1365. Accordingly, the front surface of the support frame is non planar. To compensate for the curve in framing element 1364, the posts 1370 are inserted into framing element 1364 to different depths. For example, as shown in FIG. 13, the post 1370A on the left is inserted into framing element 1364 to a first depth 1382A and the post 1370B on the right is inserted into framing element 1364 to a second depth 1382B that is shallower than first depth 1382A. Accordingly, the front end of posts 1370A and 1370B are disposed in a common plane 1380, despite the curvature in framing element 1364, which allows a building surface system that uses support structure 1362 to have a planar configuration. In some embodiments the difference in depths between at least two of the posts in the building surface system is at least 1 mm, e.g., at least 2 mm, e.g., at least 5 mm.

Figure 14:
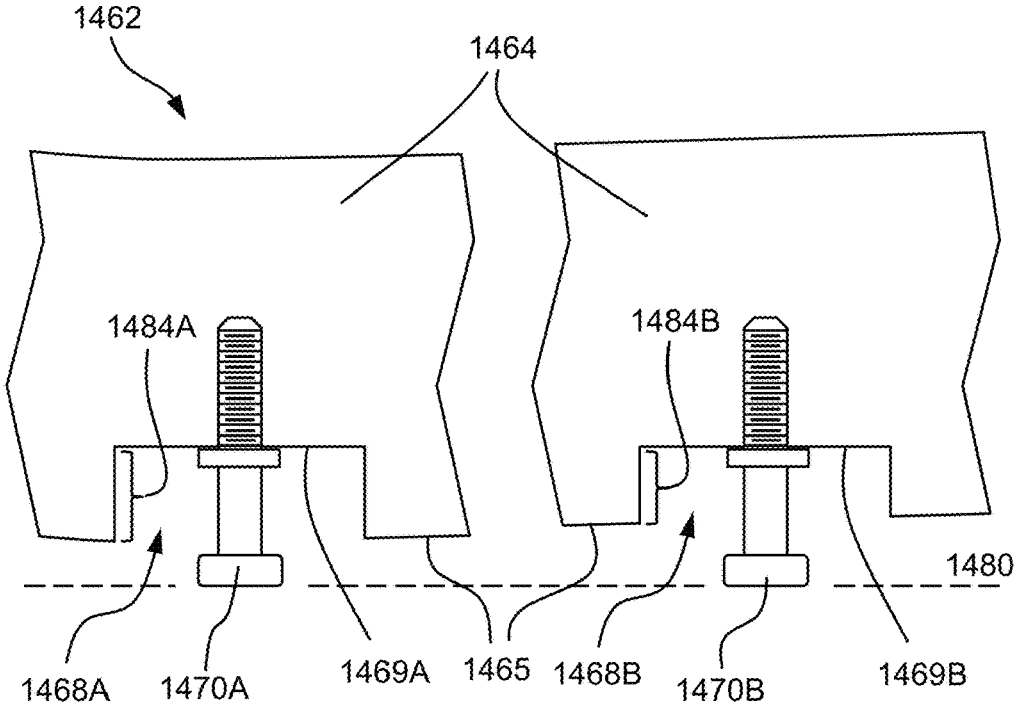
FIG. 14 is a schematic cross-sectional view of a portion of a building surface system according to another embodiment of the disclosure.

In certain embodiments of the building surface system as otherwise described herein, each of the posts is positioned within a respective notch in a corresponding framing element of the support frame, and the notches have different depths such that the base walls of the notches are provided in a common plane. A section of such a configuration is illustrated in FIG. 14. Support structure 1462 also includes a support frame with a framing element 1464 that has a slight curvature along front surface 1465. To compensate for the curve in framing element 1464, the framing element 1464 includes notches 1468A, 1468B of differing depths. For example, as shown in FIG. 14, the notch 1468A on the left includes a base wall 1469A at a first depth 1484A in framing element 1464, while the notch 1468B on the right includes a base wall 1469B at a second depth 1484B in framing element 1464 that is shallower than first depth 1484A. Accordingly, the posts 1470A and 1470B are driven to the same depths within the base walls 1469A, 1469B and the front ends of the posts 1470A, 1470B lie a common plane 1480, despite the curvature in framing element 1464. In some embodiments the difference in depths between at least two of the notches in the support frame is at least 1 mm, e.g., at least 2 mm, e.g., at least 5 mm.

Figure 15:
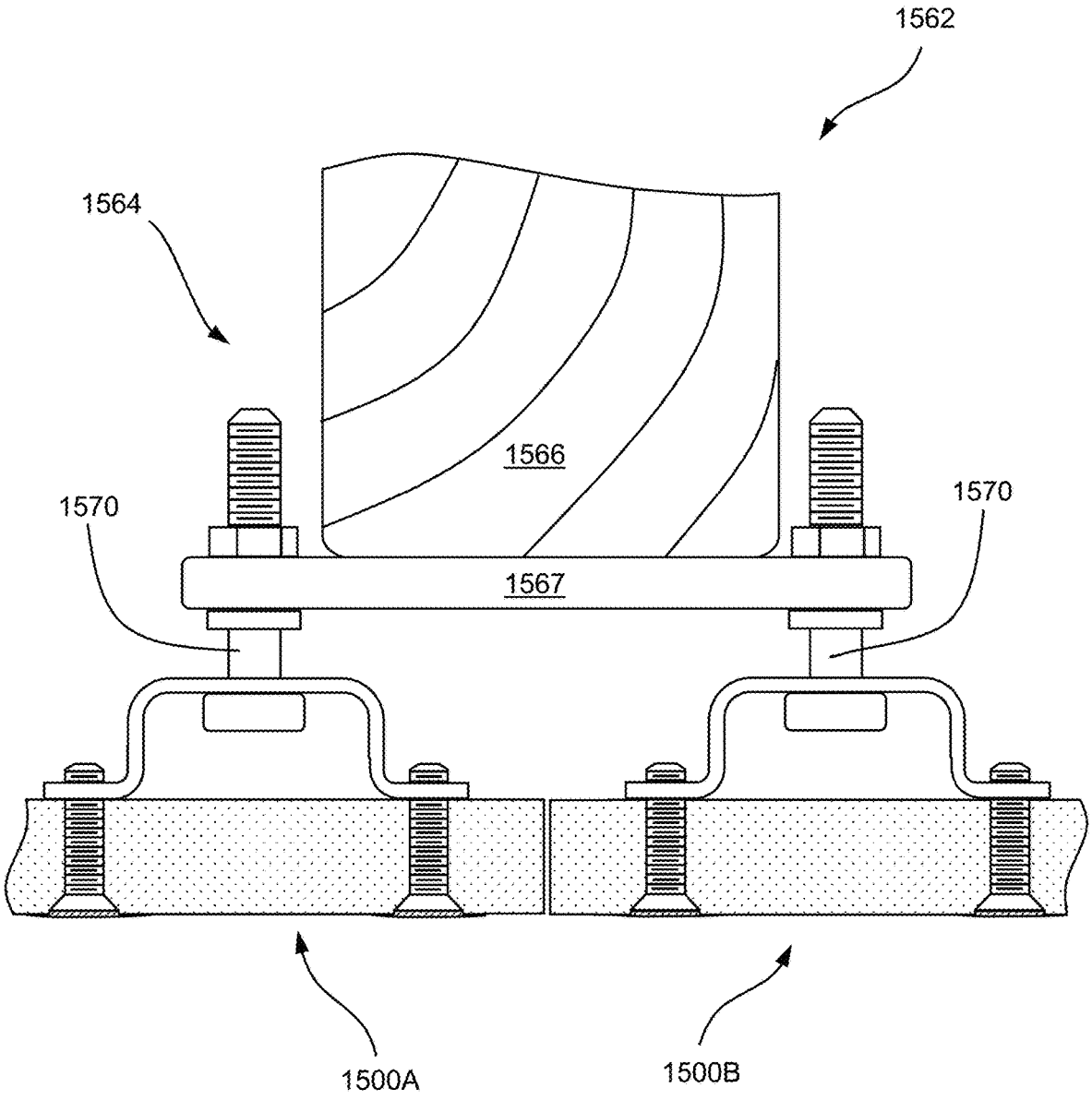
FIG. 15 is a schematic cross-sectional view of a portion of a building surface system according to another embodiment of the disclosure.

In certain embodiments of the building surface system as otherwise described herein, the framing elements include a plurality of battens disposed over a plurality of studs, and wherein the battens are wider than the studs. A section of such a configuration is illustrated in FIG. 15. Supports structure 1562 includes a support frame with a framing element 1564 that includes a stud 1566 and a batten 1567 disposed over stud 1566. Batten 1567 is wider than stud 1566 and therefore provides a larger area for the placement of posts 1570. This configuration also provides a structural advantage, as it avoids driving multiple posts across the width of the stud. With the use of batten 1567, building surface products 1500A and 1500B can be placed side by side and secured to a single framing element 1564 without sacrificing the structural integrity of the stud 1566 of the framing element 1564.

In another aspect, the disclosure provides a method of forming the building surface system according to the disclosure. The method includes positioning the first building surface product in front of the support structure such that the rear surface of the panel of the first building surface product faces the support structure and the first post is adjacent to an opening to the slot in the retaining flange of the first attachment clip of the first building surface product. The first building surface product is secured to the support structure by sliding the first building surface product with respect to the support structure such that the first post enters the slot in the retaining flange of the first attachment clip and is moved to an assembled position. In the assembled position, the first post is disposed in the slot in the retaining flange, the first post supports the first building surface product, and the first post retains the first building surface product against the support structure.

For example, to add a further building surface product 700 in one of the empty positions in building surface system 760, shown in FIG. 7, the building surface product 700 is placed in front of support structure 762 with the rear surface of the panel of the building surface product 700 facing the framing elements 764. Further, a first attachment clip on the rear surface of the panel is positioned adjacent to a corresponding post 770 on one of the framing elements 764, as shown in FIG. 8A. The building surface product 700 is then slid across the support structure 762 in order to move the first attachment clip 720 with respect to the first post 770 to an assembled position, as shown in FIG. 8B, such that the first post 770 is received in the slot 730 of the retaining flange 728 of the first attachment clip 720. The first attachment clip 720 and first post 770 then cooperate to retain the first building surface product 700 against the support structure 762.

In certain embodiments of the method as otherwise described herein, sliding the first building surface product with respect to the support structure pushes the first post past a spring catch disposed in the slot in the retaining flange of the first attachment clip such that, when the first building surface product is disposed in the assembled position, the spring catch is positioned between the post and the opening in the slot. For example, when installing building surface product 100, shown in FIGS. 1A-1D, the building surface product 100 is moved laterally until a post on a corresponding support structure is received near the closed end of the slot 130 such that the spring catch 134 is positioned between the post and the opening 133 of the slot 130.

In certain embodiments of the method as otherwise described herein, sliding the first building surface product with respect to the support structure causes a plurality of additional posts in a first group of posts to enter slots in retaining flanges of respective additional attachment clips of a first group of attachment clips on the rear surface of the panel of the building surface product. For example, when securing an additional building surface product 700 to the support structure 762, as described above, in addition to the first attachment clip and first post, each of the other attachment clips on the rear surface of the panel move with respect to a respective post in order to place the respective post into a respective slot in a retaining flange of the corresponding attachment clip. Accordingly, a group of attachment clips and corresponding posts all assist in retaining the building surface product 700 against the support structure 762.

In certain embodiments of the method as otherwise described herein, the method further includes positioning a second building surface product in front of the support structure such that a rear surface of a panel of the second building surface product faces the support structure and a second post of the support structure is adjacent to an opening to a slot in a retaining flange of the second attachment clip of the second building surface product, and sliding the second building surface product with respect to the support structure such that the second post enters the slot in the retaining flange of the second attachment clip and is moved to an assembled position where the second post is disposed in the slot in the retaining flange, the second post supports the second building surface product, and the second post retains the second building surface product against the support structure. For example, when installing the building surface system 760, shown in FIG. 7, each of the building surface product 700 is secured to the support structure 762 in a manner similar to that described above, where attachment clips of the building surface products are secured to respective posts 770 of the support structure 762.

In certain embodiments of the method as otherwise described herein, the method further includes forming the support structure, which includes assembling a plurality of framing elements so as to form a support frame and attaching a plurality of posts to a front surface of the support frame. Further, in some embodiments, attaching the plurality of posts to the front surface of the support frame includes driving the posts into a front surface of the support frame. For example, in forming support structure 762 of building surface system 760, the support frame 763 is assembled by connecting the framing elements 764 using fasteners, such as screws. The posts 770 are then driven into the front surface 765 of the support frame 763.

In certain embodiments of the method as otherwise described herein, the plurality of posts are driven to different depths in the front surface of the support frame such that the front ends of the plurality of posts are disposed in a common plane. For example, as shown in FIG. 13, in some embodiments, where a framing element 1364 of the support structure 1362 is non-planar, the posts 1370A, 1370B may be driven into the framing element 1364 to different depths such that the front ends of the posts 1370A, 1370B lie in a common plane 1380.

In certain embodiments of the method as otherwise described herein, forming the support frame includes forming a plurality of notches in the front surface of the support frame, and the plurality of posts are attached to the front surface of the support frame at the notches. For example, the framing elements 764 of support frame 763, as shown in FIG. 7, include notches 768 formed in the front surface 765 of the support frame 763. The posts 770 are then driven into the support frame 763 at the notches 768.

In certain embodiments of the method as otherwise described herein, the notches are formed at different depths in the support frame so as to be disposed in a common plane. For example, as shown in FIG. 14, in some embodiments, where a framing element 1464 of the support structure 1462 is non-planar, the framing element 1464 may include notches 1468A, 1468B in the front surface 1465 of the framing element 1464 and the notches 1468A, 1468B may have different depths such that the respective base walls 1469A, 1469B lie in a common plane. As a result, the front ends of the posts 1470A, 1470B that are driven into the respective base walls 1469A, 1469B lie in a common plane 1480.

In certain embodiments of the method as otherwise described herein, the method further includes attaching the first attachment clip to the rear surface of the panel of the first building surface product before securing the first building surface product to the support structure. For example, in building surface system 760, as shown in FIGS. 7-9, the first attachment clip 720 is secured to the rear surface 709 of panel 702 before building surface product 700 is secured to support structure 762. Thus, the first fastener 740 and second fastener 744 may be inserted into panel 702 and connected to attachment clip 720 at a remote location from the support structure 762, such as in a manufacturing facility. This allows the attachment clips 720 to be connected to the fasteners 740, 744 using more precise and efficient tools. Further, this differs from traditional panel installation methods, where fasteners are driven through the panel at the installation location and directly secure the panels to the support structure.

In some embodiments, an aperture is provided in the panel before the first fastener is inserted through the panel. For example, in some embodiments, an aperture is provided in the panel at a manufacturing facility using a precise tool, such as a CNC machine. In other embodiments, the aperture is provided through the panel at an installation location, such as by using a drill. In some embodiments, positioning the aperture on the panel is guided using a tool, such as a fixture or jig. For example, in some embodiments, a builder uses a fixture to establish the position of an aperture on the panel and forms the aperture using a drill. Still, in other embodiments, each fastener is inserted into the panel without the prior formation of an aperture. For example, in some embodiments, each fastener is driven into the core of the panel.

In some embodiments, a panel is adapted to utilize the attachment clip and is provided as a separate structure from the attachment clip and fasteners. Such a panel may contain a plurality of apertures that are pre-drilled through the core of the panel, wherein the attachment clip is attached through selected pre-drilled apertures at locations that correspond to the desired connection points to mate with posts of the support structure. In some embodiments, such apertures are distributed across both the length and width of the panel, in either regular repeating patterns or in unevenly distributed locations. For example, in some embodiments the panel contains additional sets of apertures at the ends or near corners, and has fewer sets in the center of the span. Such options for installation may allow for more secure connections, and fewer requirements for field modification of the panels themselves. It may also allow for the re-positioning of previously installed attachment clips in the case of obstruction, mis-alignment with the framing elements, missing framing elements, or a need to shorten a standard length panel.

In certain embodiments of the method as otherwise described herein, the method further includes covering the front end of the first attachment clip with joint compound before securing the first building surface product to the support structure. For example, in building surface system 760, the front ends of first fastener 740 and second fastener 744 are covered with joint compound 748 (see FIG. 9) before the building surface product 700 is secured to the support structure 762. Thus, the fasteners 740, 744 may be covered with the joint compound 748 at a remote location from the support structure, such as in a manufacturing facility, which allows more precise and efficient tools to be used to cover the fasteners. This also differs from traditional panel installation methods, where the fasteners must be covered and obscured at the installation location, which requires both time and skill to complete.

Embodiments

Embodiment 1. A building surface product comprising:

a substantially planar panel having a first side, a second side, a first end, a second end, a front surface, a rear surface, and a gypsum body between the front surface and rear surface;

a first attachment clip secured to the rear surface of the panel, the first attachment clip including:

a first leg extending outward from the rear surface of the panel, and a retaining flange coupled to the first leg, the retaining flange extending over the rear surface in a first direction and including a slot configured to receive a post so as to secure the building surface product to a support structure; and a first fastener that penetrates the rear surface of the panel, the first fastener being attached to the first leg so as to secure the attachment clip to the panel.

Embodiment 2. The building surface product according to embodiment 1, wherein the gypsum body includes a front layer and a reinforcing layer disposed behind the front layer, wherein the first fastener extends through the reinforcing layer and into the front layer.

Embodiment 3. The building surface product according to embodiment 2, wherein the reinforcing layer includes a first section along a first edge of the panel, and wherein the first section is disposed behind the front layer along the first edge.

Embodiment 4. The building surface product according to embodiment 3, wherein the gypsum body includes a first edge section between the front layer and the first section of the reinforcing layer at the first edge.

Embodiment 5. The building surface product according to embodiment 4, wherein the front layer has a first tapered face along the first edge, the first section of the reinforcing layer has a tapered face along the first edge, and the first edge section has a triangular shape including a front face that is adjacent to the first tapered face of the front layer and a rear face that is adjacent to the tapered face of the first section of the reinforcing layer.

Embodiment 6. The building surface product according to embodiment 4 or embodiment 5 wherein the front layer, the first edge section, and the first section of the reinforcing layer are formed from a machined and folded gypsum sheet.

Embodiment 7. The building surface product according to any of embodiments 4 to 6, wherein a continuous facing sheet extends around the first edge so as to cover a rear face of the first section of the reinforcing layer, an outer face of the first edge section, and the front face of the front layer.

Embodiment 8. The building surface product according to any of embodiments 5 to 7, wherein an adhesive layer is provided between the first tapered face of the front layer and the front face of the first edge section.

Embodiment 9. The building surface product according to any of embodiments 5 to 8, wherein an adhesive layer is provided between the tapered face of the first section of the reinforcing layer and the rear face of the first edge section.

Embodiment 10. The building surface product according to any of embodiments 3 to 9, wherein an adhesive layer is provided between the front layer and the first section of the reinforcing layer.

Embodiment 11. The building surface product according to embodiment 10, wherein the first fastener extends through the adhesive layer provided between the front layer and the first section of the reinforcing layer.

Embodiment 12. The building surface product according to any of embodiments 3 to 11, wherein a pair of facing sheets is provided between the front layer and the first section of the reinforcing layer.

Embodiment 13. The building surface product according to any of embodiments 2 to 12, wherein the reinforcing layer extends around a perimeter of the panel.

Embodiment 14. The building surface product according to any of embodiments 12 to 13, wherein the reinforcing layer includes a section along each edge of the panel.

Embodiment 15. The building surface product according to embodiment 14, wherein the gypsum body includes an edge section along each edge of the panel between the front layer and respective section of the reinforcing layer.

Embodiment 16. The building surface product according to any of embodiments 1 to 15, wherein the panel includes a first receiver sleeve and the first fastener extends into the first receiver sleeve.

Embodiment 17. The building surface product according to embodiment 16, wherein the first receiver sleeve extends through the reinforcing layer and into the front layer.

Embodiment 18. The building surface product according to embodiment 16 or embodiment 17, wherein the first receiver sleeve includes a threaded interior surface configured to engage the first fastener.

Embodiment 19. The building surface product according to any of embodiments 16 to 18, wherein the first receiver sleeve includes an external flange disposed between the front layer and the reinforcing layer.

Embodiment 20. The building surface panel according to any of embodiments 1 to 19, wherein the panel includes a first aperture extending through the gypsum body from the front surface to the rear surface, and wherein the first fastener extends through the first aperture.

Embodiment 21. The building surface product according to embodiment 20, wherein a front end of the first fastener includes a head that is larger than the first aperture so as to hold the first fastener within the first aperture.

Embodiment 22. The building surface product according to embodiment 20 or embodiment 21, wherein a front end of the first fastener is covered with joint compound.

Embodiment 23. The building surface product according to embodiment 20 or embodiment 21, wherein the front end of first fastener is covered with paint.

Embodiment 24. The building surface product according to any of embodiments 1 to 23, wherein the first attachment clip is one of a plurality of attachment clips secured to the rear surface of the panel, each of the plurality of attachment clips including a respective first leg extending outward from the rear surface and a respective retaining flange coupled to the respective first leg, wherein the respective first leg is attached to a respective first fastener that penetrates the rear surface of the panel.

Embodiment 25. The building surface product according to any of embodiments 1 to 24, wherein the first attachment clip includes a second leg extending outward from the rear surface of the panel and coupled to the retaining flange, and wherein the building surface product includes a second fastener that penetrates the rear surface of the panel and is attached to the second leg so as to further secure the attachment clip to the panel.

Embodiment 26. The building surface product according to embodiment 25, wherein the first and second legs are arranged in a line that extends in the first direction, and wherein a depth of the slot extends in the first direction.

Embodiment 27. The building surface product according to any of embodiments 1 to 26, wherein the first leg of the attachment clip includes a first foot that lies against the rear surface of the panel, and wherein the first fastener penetrates the first foot so as to attach the first fastener to the first leg.

Embodiment 28. The building surface product according to any of embodiments 1 to 27, wherein the retaining flange includes a first edge on one side of the slot and a second edge on the other side of the slot, wherein the first and second edges are configured to abut an outwardly extending lip of the post.

Embodiment 29. The building surface product according to any of embodiments 1 to 28, wherein the slot widens to an opening in the first leg, and wherein a width of the opening is greater than a width of the slot.

Embodiment 30. The building surface product according to any of embodiments 1 to 29, wherein the first direction is parallel to the plane of the panel.

Embodiment 31. The building surface product according to any of embodiments 1 to 30, wherein the retaining flange is formed as a plate.

Embodiment 32. The building surface product according to embodiment 31, wherein the plate is parallel to the panel.

Embodiment 33. The building surface product according to any of embodiments 1 to 32, wherein the first attachment clip is formed from a bent metal plate.

Embodiment 34. The building surface product according to any of embodiments 1 to 33, wherein the first fastener includes a threaded shaft.

Embodiment 35. The building surface product according to any of embodiments 1 to 34, wherein the first attachment clip includes a spring catch that extends into the slot and is configured to secure the post in the slot.

Embodiment 36. The building surface product according to any of embodiments 1 to 35, wherein the gypsum body comprises a reinforced gypsum material.

Embodiment 37. The building surface product according to any of embodiments 1 to 36, wherein the gypsum body includes at least 1% by weight polymer.

Embodiment 38. The building surface product according to embodiment 37, wherein the polymer includes starch and/or polyvinyl acetate.

Embodiment 39. The building surface product according to any of embodiments 1 to 38, wherein the gypsum body includes at least 1% by weight of reinforcing fibers.

Embodiment 40. The building surface product according to any of embodiments 1 to 39, wherein the panel is rectangular.

Embodiment 41. The building surface product according to any of embodiments 1 to 39, wherein at least one of the first side, second side, first end, and second end includes a non-linear edge.

Embodiment 42. The building surface product according to embodiment 41, wherein the non-linear edge includes a plurality of projections and indentations.

Embodiment 43. The building surface product according to any of embodiments 1 to 42, further comprising a facing that lines the gypsum body along at least one of the front surface and the rear surface.

Embodiment 44. The building surface product according to embodiment 43, wherein the facing is a paper facing.

Embodiment 45. The building surface product according to any of embodiments 1 to 44, wherein a width of the panel from the first side to the second side is at least 3 inches, e.g., at least 4 inches, e.g., at least 6 inches.

Embodiment 46. The building surface product according to any of embodiments 1 to 45, wherein a width of the panel from the first side to the second side is no more than 6 feet, e.g., no more than 4 feet, e.g., no more than 3 feet.

Embodiment 47. The building surface product according to any of embodiments 1 to 46, wherein a length of the panel from the first end to the second end is at least 1 foot, e.g., at least 2 feet, e.g., at least 4 feet.

Embodiment 48. The building surface product according to any of embodiments 1 to 47, wherein a length of the panel from the first end to the second end is no more than 20 feet, e.g., no more than 15 feet, e.g., no more than 12 feet.

Embodiment 49. The building surface product according to any of embodiments 1 to 48, wherein a thickness of the panel is at least ⅜ inch, e.g., at least ½ inch, e.g., at least ¾ inch.

Embodiment 50. The building surface product according to any of embodiments 1 to 49, wherein a thickness of the panel is no more than 4 inches, e.g., no more than 3 inches, e.g., no more than 2 inches.

Embodiment 51. A building surface system comprising:

a support structure comprising:

a plurality of framing elements forming a support frame, a first post extending outward from a front surface of the support frame; and a first building surface product according to any of embodiments 1 to 50 secured to the support structure, wherein the slot in the retaining flange of the first attachment clip of the first building surface product receives the first post of the support structure so as to attach the first building surface product against the support structure.

Embodiment 52. The building surface system according to embodiment 51, wherein the first post includes a shaft and a lip extending radially outward from the shaft, wherein the shaft of the first post is received in the slot in the retaining flange of the first attachment clip, and wherein the lip of the first post is positioned between the retaining flange of the first attachment clip and the rear surface of the panel.

Embodiment 53. The building surface system according to embodiment 52, wherein the lip is formed as a portion of a head on a front end of the first post.

Embodiment 54. The building surface system according to any of embodiments 51 to 53, wherein the first post includes a shaft that penetrates the front surface of the support frame.

Embodiment 55. The building surface system according to embodiment 54, wherein the first post includes a collar surrounding the shaft that engages the front surface of the support frame.

Embodiment 56. The building surface system according to any of embodiments 51 to 55, wherein the first attachment clip includes a spring catch that extends into the slot from a side edge of the slot, and wherein the spring catch is positioned between the first post and the opening of the slot so as to hinder removal of the first post from the slot.

Embodiment 57. The building surface system according to any of embodiments 51 to 56, further comprising a spring in operative engagement between the first post and the first attachment clip so as to urge the first attachment clip toward a mounted position.

Embodiment 58. The building surface system according to embodiment 57, wherein the spring urges the first attachment clip toward the front surface of the support structure.

Embodiment 59. The building surface system according to embodiment 57, wherein the spring urges the first attachment clip away from the front surface of the support structure.

Embodiment 60. The building surface system according to embodiment 58 or embodiment 59, wherein the spring is disposed on the first post.

Embodiment 61. The building surface system according to embodiment 58 or embodiment 59, wherein the spring is disposed on the first attachment clip.

Embodiment 62. The building surface system according to any of embodiments 51 to 61, wherein the framing element includes a first notch, wherein the first post extends outward from within the first notch, and wherein a majority of the first attachment clip is positioned within the notch.

Embodiment 63. The building surface system according to any of embodiments 51 to 62, wherein the first post is one of a first group of posts extending outward from the front surface of the support frame, wherein the first attachment clip is one of a first group of attachment clips provided on the rear surface of the panel of the first building surface product, and wherein each post of the first group of posts is secured in a respective attachment clip of the first group of attachment clips to hold the first building surface product against the support structure.

Embodiment 64. The building surface system according to embodiment 63, wherein the support structure includes a plurality of groups of posts, wherein the first building surface product is one of a plurality of building surface products, and wherein each of the building surface products is secured to a respective group of posts of the support structure.

Embodiment 65. The building surface system according to embodiment 63 or embodiment 64, wherein front ends of the respective posts of the support structure are disposed in a common plane.

Embodiment 66. The building surface system according to embodiment 65, wherein the posts of the support structure penetrate the support frame to different depths so that the front ends thereof are disposed in the common plane.

Embodiment 67. The building surface system according to embodiment 64, wherein each of the posts is positioned within a respective notch in a corresponding framing element of the support frame, and wherein the notches have different depths such that the base walls of the notches are provided in a common plane.

Embodiment 68. The building surface system according to any of embodiments 51 to 67, wherein the framing elements include a plurality of battens disposed over a plurality of studs, and wherein the battens are wider than the studs.

Embodiment 69. A method of forming the building surface system according to any of embodiments 51 to 68, the method comprising:

positioning the first building surface product in front of the support structure such that the rear surface of the panel of the first building surface product faces the support structure and the first post is adjacent to an opening to the slot in the retaining flange of the first attachment clip of the first building surface product; and securing the first building surface product to the support structure by sliding the first building surface product with respect to the support structure such that the first post enters the slot in the retaining flange of the first attachment clip and is moved to an assembled position where the first post is disposed in the slot in the retaining flange, the first post supports the first building surface product, and the first post retains the first building surface product against the support structure.

Embodiment 70. The method according to embodiment 69, wherein sliding the first building surface product with respect to the support structure pushes the first post past a spring catch disposed in the slot in the retaining flange of the first attachment clip such that, when the first building surface product is disposed in the assembled position, the spring catch is positioned between the post and the opening in the slot.

Embodiment 71. The method according to embodiment 69 or embodiment 70 wherein sliding the first building surface product with respect to the support structure causes a plurality of additional posts in a first group of posts to enter slots in retaining flanges of respective additional attachment clips of a first group of attachment clips on the rear surface of the panel of the building surface product.

Embodiment 72. The method according to any of embodiments 69 to 71, further comprising positioning a second building surface product in front of the support structure such that a rear surface of a panel of the second building surface product faces the support structure and a second post of the support structure is adjacent to an opening to a slot in a retaining flange of the second attachment clip of the second building surface product; and sliding the second building surface product with respect to the support structure such that the second post enters the slot in the retaining flange of the second attachment clip and is moved to an assembled position where the second post is disposed in the slot in the retaining flange, the second post supports the second building surface product, and the second post retains the second building surface product against the support structure.

Embodiment 73. The method according to any of embodiments 69 to 72, further comprising forming the support structure, wherein forming the support structure includes:

assembling a plurality of framing elements so as to form a support frame; and attaching a plurality of posts to a front surface of the support frame.

Embodiment 74. The method according to embodiment 73, wherein attaching the plurality of posts to the front surface of the support frame includes driving the posts into a front surface of the support frame.

Embodiment 75. The method according to embodiment 74, wherein the plurality of posts are driven to different depths in the front surface of the support frame such that the front ends of the plurality of posts are disposed in a common plane.

Embodiment 76. The method according to embodiment 73 or embodiment 74, wherein forming the support frame includes forming a plurality of notches in the front surface of the support frame, and wherein the plurality of posts are attached to the front surface of the support frame at the notches.

Embodiment 77. The method according to embodiment 76, wherein the notches are formed at different depths in the support frame so as to be disposed in a common plane.

Embodiment 78. The method according to any of embodiments 69 to 77, further comprising attaching the first attachment clip to the rear surface of the panel of the first building surface product before securing the first building surface product to the support structure.

Embodiment 79. The method according to embodiment 78, further comprising covering the front end of the first attachment clip with joint compound before securing the first building surface product to the support structure.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A building surface system comprising:

a building support structure comprising a support frame comprising a plurality of framing elements selected from a group consisting of wall studs and ceiling joists; and a plurality of posts, each post extending outward from a front surface of a framing element of the support frame; and a plurality of building surface products, each building surface product comprising:

a substantially planar panel having a first side, a second side, a first end, a second end, a front surface, a rear surface, and a gypsum body between the front surface and rear surface;

a plurality of attachment clips secured to the rear surface of the panel, each of the attachment clips including:

a first leg extending outward from the rear surface of the panel, and a retaining flange coupled to the first leg, the retaining flange extending over the rear surface in a first direction and including a slot configured to receive the post so as to secure the building surface product to the support frame; and a plurality of fasteners that penetrate the rear surface of the panel, each fastener being attached to the first leg of one of the attachment clips so as to secure the respective attachment clip to the panel, wherein for each of the attachment clips, the slot in the retaining flange of the attachment clip receives one of the posts of the support structure so as to attach the respective building surface product against the support frame, and wherein in each of the building surface products, the panel includes a plurality of receiver sleeves and each fastener of the plurality of fasteners extends into a receiver sleeve of the plurality of receiver sleeves, and in each of the building surface products, the gypsum body includes a front layer and a reinforcing layer disposed behind the front layer, the fastener extending through the reinforcing layer and into the front layer, and the receiver sleeve includes an external flange disposed between the front layer and the reinforcing layer.

2. The building surface system according to claim 1, wherein in each of the building surface products, the reinforcing layer includes a first section along a first edge of the panel, and wherein the first section is disposed behind the front layer along the first edge.

3. The building surface system according to claim 2, wherein in each of the building surface products, the gypsum body includes a first edge section between the front layer and the first section of the reinforcing layer at the first edge.

4. The building surface system according to claim 3, wherein in each of the building surface products, the front layer, the first edge section, and the first section of the reinforcing layer are formed from a machined and folded gypsum sheet.

5. The building surface system according to claim 3, wherein in each of the building surface products, a continuous facing sheet extends around the first edge so as to cover a rear face of the first section of the reinforcing layer, an outer face of the first edge section, and the front face of the front layer.

6. The building surface system according to claim 1, wherein in each of the building surface products, wherein a pair of facing sheets is provided between the front layer and the first section of the reinforcing layer.

7. The building surface system according to claim 1, wherein for each of the fasteners of the building surface products, a front end of the fastener includes a head that is larger than the respective receiver sleeve so as to hold the fastener within the receiver sleeve.

8. The building surface system according to claim 7, wherein for each of the fasteners of the building surface products, a front end of the fastener is covered with joint compound or paint.

9. The building surface system according to claim 1, wherein each respective post includes a shaft that penetrates a front surface of the respective support frame and a lip extending radially outward from the shaft, wherein the shaft of the post is received in the slot in the retaining flange of the first respective attachment clip, and wherein the lip of the respective post is positioned between the retaining flange of the respective first attachment clip and the rear surface of the respective panel.

10. The building surface system according to claim 1, wherein the plurality of posts comprise a first group of posts, a first building surface product of the plurality of building surface products comprises a first group of the attachment clips provided on the rear surface of the panel of the first building surface product, and each post of the first group of posts is secured in a respective attachment clip of the first group of attachment clips to hold the first building surface product against the support frame.

11. The building surface system according to claim 1, wherein the plurality of posts comprise a first group of posts, front ends of the posts of the first group of posts being disposed in a common plane, a first building surface product of the plurality of building surface products comprises a first group of the attachment clips provided on the rear surface of the panel of the first building surface product, and each post of the first group of posts is secured in a respective attachment clip of a first group of attachment clips to hold the first building surface product against the support frame.

12. The building surface system according to claim 11, wherein the posts of the first group of posts penetrate the support frame of the first building surface product to different depths so that the front ends thereof are disposed in the common plane.

13. The building surface system according to claim 11, wherein each of the posts of the first group of posts is positioned within a respective notch in a corresponding framing element of the support frame, and wherein the notches have different depths such that base walls of the notches are provided in a common plane.

14. A method of forming a building surface system according to claim 1, the method comprising:

providing the building support structure;

providing the plurality of building surface products;

positioning a first building surface product of the plurality of building surface products in front of the building support structure, wherein the first building surface product is positioned such that the rear surface of the panel of the first building surface product faces the support structure and such that each post of a first group of posts of the plurality of posts is adjacent to an opening to the slot in the retaining flange of a respective attachment clip of the first building surface product; and securing the first building surface product to the support structure by sliding the first building surface product with respect to the support structure such that each post of the first group of posts enters the slot in the retaining flange of the respective attachment clip and is moved to an assembled position where the respective post is disposed in the slot in the respective retaining flange, and the first group of posts supports the first building surface product and retains the first building surface product against the support frame;

positioning a second building surface product of the plurality of building surface products in front of the building support structure, wherein the second building surface product is positioned such that the rear surface of the panel of the second building surface product faces the support structure and such that each post of a second group of posts of the plurality of posts is adjacent to an opening to the slot in the retaining flange of a respective attachment clip of the second building surface product; and securing the second building surface product to the support structure by sliding the second building surface product with respect to the support structure such that each post of the second group of posts enters the slot in the retaining flange of the respective attachment clip and is moved to an assembled position where the respective post is disposed in the slot in the respective retaining flange, and the first group of posts supports the first building surface product and retains the first building surface product against the support frame.

15. The building surface system according to claim 1, wherein the framing elements are wall studs.

16. The building surface system according to claim 15, wherein the plurality of building surface products includes a first plurality of building products disposed vertically, such that for every building surface product but for an lowermost building surface product a second side of the building surface product is disposed substantially against a first side of a next lower building surface product, and for every building surface product but for an uppermost building surface product, a first side of the building surface product is disposed substantially against a second side of a next upper building surface product.

17. A building surface product comprising:

a substantially planar panel having a first side, a second side, a first end, a second end, a front surface, a rear surface, and a gypsum body between the front surface and rear surface, the gypsum body including a front layer and a reinforcing layer disposed behind the front layer, the reinforcing layer including a first section along a first edge of the panel, the first section being disposed behind the front layer along the first edge;

a first attachment clip secured to the rear surface of the panel, the first attachment clip including:

a first leg extending outward from the rear surface of the panel, and a retaining flange coupled to the first leg, the retaining flange extending over the rear surface in a first direction and including a slot configured to receive a post so as to secure the building surface product to a support structure; and a first fastener that penetrates the rear surface of the panel, the first fastener being attached to the first leg so as to secure the attachment clip to the panel, wherein the gypsum body includes a first edge section between the front layer and the first section of the reinforcing layer at the first edge, and the front layer, the first edge section, and the first section of the reinforcing layer are formed from a machined and folded gypsum sheet; or a continuous facing sheet extends around the first edge so as to cover a rear face of the first section of the reinforcing layer, an outer face of the first edge section, and the front face of the front layer.

18. A building surface product comprising:

a substantially planar panel having a first side, a second side, a first end, a second end, a front surface, a rear surface, and a gypsum body between the front surface and rear surface;

a first attachment clip secured to the rear surface of the panel, the first attachment clip including:

a first leg extending outward from the rear surface of the panel, and a retaining flange coupled to the first leg, the retaining flange extending over the rear surface in a first direction and including a slot configured to receive a post so as to secure the building surface product to a support structure; and a first fastener that penetrates the rear surface of the panel, the first fastener being attached to the first leg so as to secure the attachment clip to the panel, wherein the panel includes a first receiver sleeve and the first fastener extends into the first receiver sleeve, the gypsum body includes a front layer and a reinforcing layer disposed behind the front layer, the first fastener extending through the reinforcing layer and into the front layer, and the first receiver sleeve includes an external flange disposed between the front layer and the reinforcing layer.

* * * * *